US009732451B2

(12) United States Patent
Lee et al.

(10) Patent No.: US 9,732,451 B2
(45) Date of Patent: Aug. 15, 2017

(54) FINE KNITWEAR OF CIRCULAR KNITTING MACHINES WITH AIR PERMEABLE HOLES

(71) Applicant: PAI LUNG MACHINERY MILL CO., LTD., New Taipei (TW)

(72) Inventors: Hsin-Chung Lee, New Taipei (TW); Shu-Jung Yu, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 62 days.

(21) Appl. No.: 14/933,365

(22) Filed: Nov. 5, 2015

(65) Prior Publication Data

US 2017/0130373 A1 May 11, 2017

(51) Int. Cl.

| | |
|---|---|
| ***D04B 1/24*** | (2006.01) |
| ***D04B 1/10*** | (2006.01) |
| ***D04B 9/06*** | (2006.01) |
| ***D04B 9/42*** | (2006.01) |

(52) U.S. Cl.

CPC ..... *D04B 1/104* (2013.01); *D04B 1/24* (2013.01); *D04B 9/065* (2013.01); *D04B 9/42* (2013.01)

(58) Field of Classification Search

CPC ..... D04B 1/104; D04B 1/24; D04B 9/065; D04B 9/442

See application file for complete search history.

(56) References Cited

U.S. PATENT DOCUMENTS

| | | | | | |
|---|---|---|---|---|---|
| 865,660 | A * | 9/1907 | Scott | D04B 1/06 | 66/198 |
| 2,021,598 | A * | 11/1935 | Gastrich | D04B 1/104 | 66/180 |
| 2,403,201 | A * | 7/1946 | Wildt | D04B 1/104 | 66/198 |
| 2,657,561 | A * | 11/1953 | Holmes | D04B 9/06 | 66/175 |
| 3,137,150 | A * | 6/1964 | Mishcon | D04B 1/104 | 66/169 R |
| 4,267,710 | A * | 5/1981 | Imamichi | D04B 1/12 | 66/196 |
| 4,570,461 | A * | 2/1986 | Sawazaki | D04B 1/02 | 66/194 |
| 4,941,331 | A * | 7/1990 | Cournoyer | D04B 1/126 | 66/196 |
| 6,170,299 | B1 * | 1/2001 | Apollonio | D04B 9/38 | 66/13 |

(Continued)

*Primary Examiner* — Danny Worrell

(74) *Attorney, Agent, or Firm* — Muncy, Geissler, Olds & Lowe, P.C.

(57) ABSTRACT

A fine knitwear of circular knitting machines with air permeable holes is a single face fabric knitted via a circular knitting machine with knitting fineness ≥24 needles/inch. Each air permeable hole includes: at least one yarn located above the air permeable hole and formed via interactive movements of a Dial sinker and a plurality of latch needles perpendicular to the Dial sinker, and a first support loop and a second support loop that are formed via interactive movements of the Dial sinker and the latch needles and symmetrical against the yarn on the left side and the right side to support and tie the transferred yarn. The fine knitwear can meet market and consumers' requirements of providing more comfortable cooling, and the width of the air permeable holes can be changed flexibly in response to different requirements in the industry.

4 Claims, 26 Drawing Sheets

(56) References Cited

U.S. PATENT DOCUMENTS

| | | | | |
|---|---|---|---|---|
| 6,199,409 | B1 * | 3/2001 | Shibata | D04B 9/38 66/148 |
| 6,539,752 | B1 * | 4/2003 | Apollonio | D04B 1/104 66/180 |
| 6,871,515 | B1 * | 3/2005 | Starbuck | D04B 1/104 66/169 R |
| 7,389,657 | B2 * | 6/2008 | Lonati | D04B 1/104 66/173 |
| 7,536,879 | B2 * | 5/2009 | Vanwelden | D04B 1/126 66/19 |
| 7,788,953 | B1 * | 9/2010 | McMurray | D04B 1/24 66/196 |
| 8,640,503 | B2 | 2/2014 | Kunde et al. | |

* cited by examiner

FINE KNITWEAR OF CIRCULAR KNITTING MACHINES WITH AIR PERMEABLE HOLES

FIELD OF THE INVENTION

The present invention relates to a knitwear with air permeable holes and particularly to a single face fine knitwear knitted via circular knitting machines that has fineness ≥24 needles/inch.

BACKGROUND OF THE INVENTION

Nowadays people are very conscious of health, environmental protection and fashions. Consumers also have growing demand on comfort and design of their clothing fabrics. The comfort sense of clothing fabrics can be improved through air permeability or their stitching methods. On the issue of air permeability the conventional approach is knitting fabrics with a mesh structure via a warp knitting machine to form mesh knitwear with greater hole width to achieve desired air permeable effect. But such an approach cannot knit fine knitwear with fineness ≥24 needles/inch. The knitting speed also is quite slow. The deficiency in fineness and productivity become a constraint that cannot fully meet textile industry requirement.

U.S. Pat. No. 8,640,503 discloses a knitwear with a perforated structure. As shown in FIG. 1, its knitwear 10 is knitted by a double jersey knitting machine with machine fineness ≥needles/inch 24 and includes a first needle support structure and a second needle support structure opposing each other. The first needle support structure includes latch needles at a needle number per inch mating the machine fineness. The second needle support structure has transfer needles with a maximum needle number per inch one half of the latch needles of the first needle support structure. The transfer needles generate a pore 11 which includes a plurality of loop accumulations each has at least one or preferably two tuck loops 12. The tuck loops 12, in the condition of not connecting to or connecting to at least one needle leg, can be transferred from the transfer needle and suspended on the latch needle.

Based on the aforesaid technique, as shown in FIG. 1, the structure of the pore 11 formed on the knitwear 10 still has shortcomings, notably: 1. The pore 11 is formed in a symmetrical manner on the knitwear 10, namely the pore 11 is supported merely by the tuck loops 12 formed in a loop by a single latch needle on the left side or the right side, and the pore 11 also is formed in a size and shape at a smaller hole width, hence cannot meet market requirements; 2. The tuck loops 12 are formed on a single side by the transfer needle via a yarn transferred in the pore 11, hence the length of the pore 11 and the distance between neighboring pores 11 can merely be controlled by the transferred and suspended quantity of the tuck loops 12, and the size and shape of the pore 11 cannot be changed. As a result, it cannot meet emergency requirements in response to change of market.

SUMMARY OF THE INVENTION

The primary object of the present invention is to solve the shortcomings and problems of the conventional techniques, namely to meet market and consumer requirements for more comfortable cooling, and also provide flexible change of the size of air permeable holes to meet different requirements in the industry and emergency in response to change of the market.

To achieve the foregoing object the present invention provides a fine knitwear of circular knitting machines with air permeable holes. The fine knitwear is a single face fabric knitted by a circular knitting machine with knitting fineness ≥24 needles/inch. The fine knitwear includes a plurality of air permeable holes that are spaced from each other. Each air permeable hole includes: at least one transferred yarn located above the air permeable hole and formed via interactive movements of a Dial sinker (also called Dial-transfer-jack Sinker) and a plurality of latch needles perpendicular to the Dial sinker, and a first support loop and a second support loop that are formed via interactive movements of the Dial sinker and the latch needles and symmetrical against the transferred yarn on the left side and the right side of the transferred yarn to support and tie the transferred yarn.

In one aspect the fine knitwear of circular knitting machines with air permeable holes includes a first transferred yarn and a second transferred yarn that are located above each air permeable hole and formed via interactive movements of the Dial sinker and two latch needles, and the first support loop and the second support loop that are formed via interactive movements of the Dial sinker and the two latch needles and symmetrical against the first transferred yarn and the second transferred yarn on the left side and the right side of the first transferred yarn and the second transferred yarn to support and tie the first transferred yarn and the second transferred yarn.

In another aspect the fine knitwear of circular knitting machines with air permeable holes includes the first transferred yarn, the second transferred yarn and a third transferred yarn that are located above each air permeable hole and formed via interactive movements of the Dial sinker and the two latch needles, and the first support loop and the second support loop that are formed via interactive movements of the Dial sinker and the two latch needles and symmetrical against the first transferred yarn, the second transferred yarn and the third transferred yarn on the left side and the right side of the first transferred yarn, the second transferred yarn and the third transferred yarn to support and tie the first transferred yarn, the second transferred yarn and the third transferred yarn.

In yet another aspect the fine knitwear of circular knitting machines with air permeable holes includes the first transferred yarn, the second transferred yarn, the third transferred yarn and a fourth transferred yarn that are located above each air permeable hole and formed via interactive movements of the Dial sinker and the two latch needles, and the first support loop and the second support loop that are formed via interactive movements of the Dial sinker and the two latch needles and symmetrical against the first transferred yarn, the second transferred yarn, the third transferred yarn and the fourth transferred yarn on the left side and the right side of the first transferred yarn, the second transferred yarn, the third transferred yarn and the fourth transferred yarn to support and tie the first transferred yarn, the second transferred yarn, the third transferred yarn and the fourth transferred yarn.

In yet another aspect the fine knitwear of circular knitting machines with air permeable holes includes the yarn which is located above each air permeable hole and formed via interactive movements of the Dial sinker and three latch needles, and the first support loop, the second support loop and a third support loop interposed between the first support loop and the second support loop that are formed via interactive movements of the Dial sinker and the three latch needles and symmetrical against the transferred yarn to support and tie the transferred yarn.

In yet another aspect the fine knitwear of circular knitting machines with air permeable holes includes a first transferred yarn and a second transferred yarn that are located above each air permeable hole and formed via interactive movements of the Dial sinker and the three latch needles, and the first support loop, the second support loop and the third support loop that are formed via interactive movements of the Dial sinker and the three latch needles and symmetrical against the first transferred yarn and the second transferred yarn to support and tie the first transferred yarn and the second transferred yarn.

In yet another aspect the fine knitwear of circular knitting machines with air permeable holes includes a spaced loop located in each air permeable hole that is formed by yarn binding of the third support loop.

In yet another aspect the fine knitwear of circular knitting machines with air permeable holes includes the yarn located above each air permeable hole and formed via interactive movements of the Dial sinker and four latch needles, and the first support loop, the second support loop and a third support loop and a fourth support loop interposed between the first support loop and the second support loop are formed via interactive movements of the Dial sinker and the four latch needles and symmetrical against the yarn on the left side and the right side of the transferred yarn to support and tie the transferred yarn.

In yet another aspect the fine knitwear of circular knitting machines with air permeable holes includes a first transferred yarn and a second transferred yarn that are located above each air permeable hole and formed via interactive movements of the Dial sinker and the four latch needles, and the first support loop, the second support loop, the third support loop and the fourth support loop that are formed via interactive movements of the Dial sinker and the fourth latch needles and symmetrical against the first transferred yarn and the second transferred yarn to support and tie the first transferred yarn and the second transferred yarn.

In yet another aspect each air permeable hole of the fine knitwear of circular knitting machines with air permeable holes includes two spaced loops formed at the same time by yarn binding of the third support loop and the fourth support loop.

The present invention, by means of the technique set forth above, compared with the conventional techniques, can provide many advantages, notably: 1. The invention forms the air permeable hole symmetrically on the left side and the right side, hence the hole can be formed wider and at a greater distance, and the transferred yarn above the air permeable hole is securely held by at least two support loops, thus the air permeable hole can be constructed firmer to meet market requirements; 2. Because the transferred yarns above the air permeable hole are stacked over one another in a symmetrical manner on the left side and the right side, the stacked yarns form a three-dimension (3D in short hereinafter) jutting profile, thereby when the fine knitwear is in contact with people's skin each air permeable hole and the skin form a plurality of gaps between them without directly sticking to the skin, thus can generate improved air permeable effect and provide more comfortable cooling to meet consumers' requirements; 3. Through the Dial sinker not only the length of the air permeable holes can be determined by the number of the transferred yarns, the distance between neighboring air permeable holes also can be controlled by the positions of the transferred yarns; and by adjusting the shape of the Dial sinker the width or shape of the air permeable holes also can be controlled, thereby can meet emergency requirements in response to change of market.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
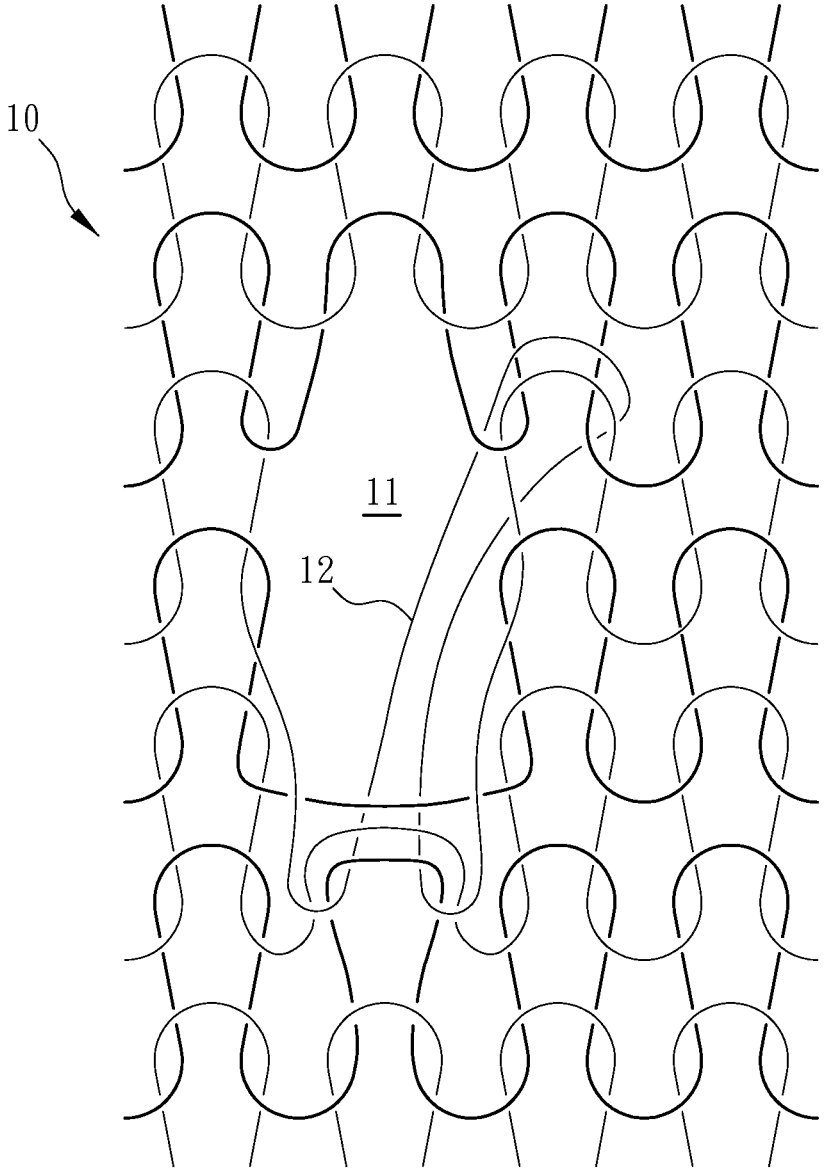
FIG. 1 is a fragmentary enlarged plane view of a conventional knitwear.
Figure 2:
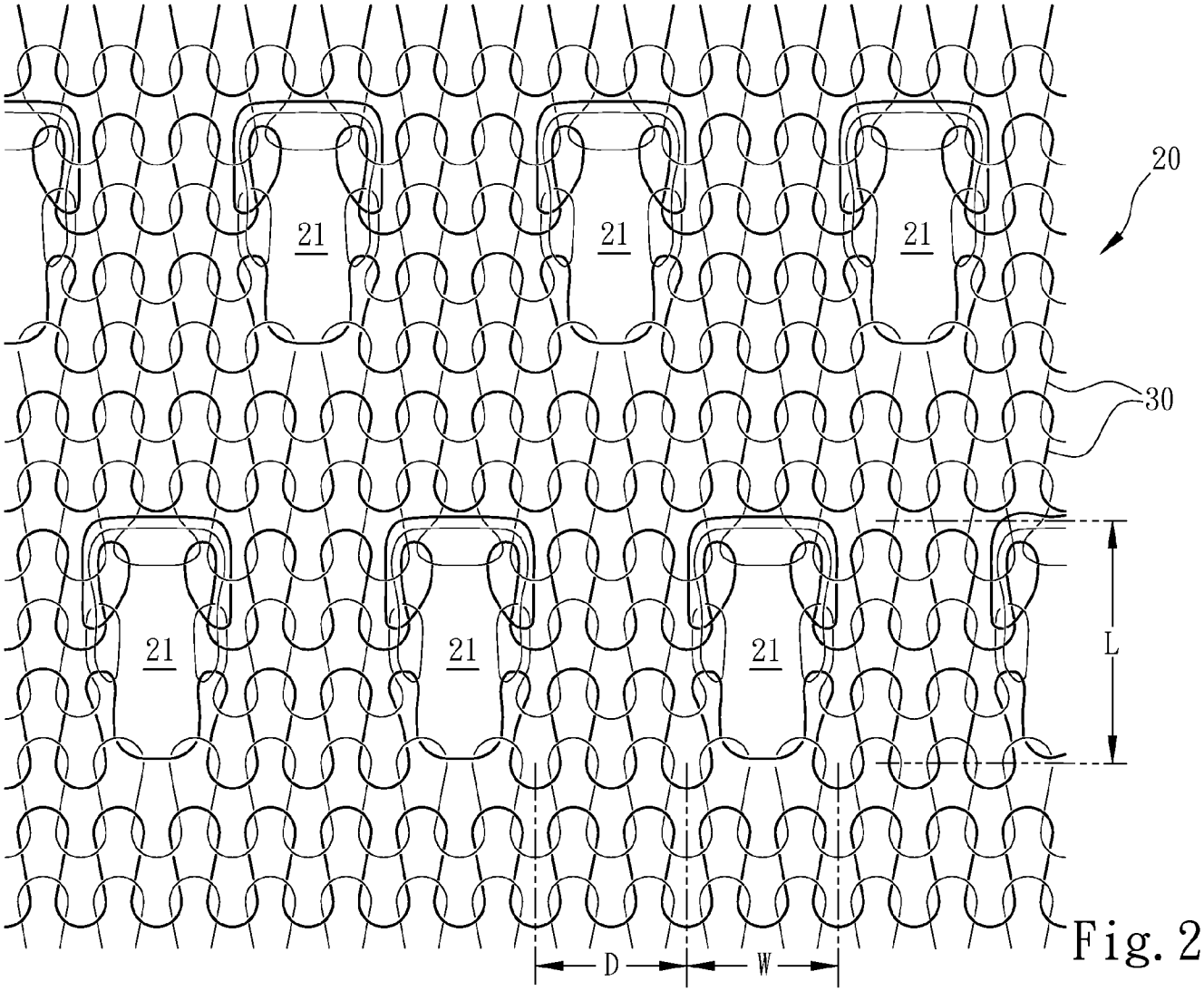
FIG. 2 is a fragmentary schematic view of a first embodiment of the invention formed by transferring the yarn twice.

Refer to FIGS. 2 through 5 for a first embodiment of the invention. It is implemented through a circular knitting machine 40 by transferring the yarn twice to produce a circular fine knitwear (rundstrickware) with air permeable holes (the main structure of the circular knitting machine 40 is known in the art, thus details are omitted in the drawings herein). The circular knitting machine 40 includes a plurality of Dial sinkers 60 and latch needles 50 at a quantity doubled the number of the Dial sinkers 60 and perpendicular to the Dial sinkers 60 with knitting fineness ≥24 needles/inch. The knitting fineness of the invention is preferably 28 needles/inch. The number of the latch needles 50 is an integer multiple of 2 or more of the number of the Dial sinkers 60, preferably 2-4 times, with optimal number at twofold of the Dial sinkers 60. Through the circular knitting machine 40 a fine knitwear 20 can be produced by knitting. The fine knitwear 20 is a single face fabric with a plurality of air permeable holes 21 spaced from one another. It is to be noted that there are transferred yarns 300 above each air permeable hole 21 that are formed via interactive movements of the Dial sinkers 60 and two sets of the latch needles 50 perpendicular and corresponding to the Dial sinkers 60 (a first example of a first transferred yarn 301 and a second transferred yarn 302 formed via the interactive movements twice is shown in the drawings for discussion), and a first support loop 311 and a second support loop 312 that are formed via interactive movement of the Dial sinkers 60 and the two latch needles 50 and symmetrical against the first transferred yarn 301 and the second transferred yarn 302 on the left side and the right side of the first transferred yarn 301 and the second transferred yarn 302 to support and tie the first transferred yarn 301 and the second transferred yarn 302. It is also to be noted that, since the air permeable hole 21 is formed in a symmetrical manner on the left side and the right side, the hole can be formed at a greater width W. Moreover, since the first transferred yarn 301 and the second transferred yarn 302 above the air permeable hole 21 are securely held by at least two support loops (the first support loop 311 and the second support loop 312), the structure of the air permeable hole 21 also is firmer, thus can meet market requirements. In addition, because the first transferred yarn 301 and the second transferred yarn 302 above the air permeable hole 21 are stacked symmetrically on the left side and the right side, a jutting 3D profile can be formed above the air permeable hole 21, therefore when the fine knitwear 20 is in contact with people's skin a plurality of gaps are formed between each air permeable hole 21 and the skin without directly sticking to the skin. As a result, an improved air permeable effect can be generated to meet consumers' requirement for more comfortable cooling. Furthermore, the Dial sinkers 60 used in the invention not only can control the length L of the hole and the distance D between the neighboring air permeable holes 21, the shape of the Dial sinkers 60 also can be adjusted to control the width W or shape of the air permeable holes 21, thus can meet emergency requirements in response to change of market.

Figure 3:
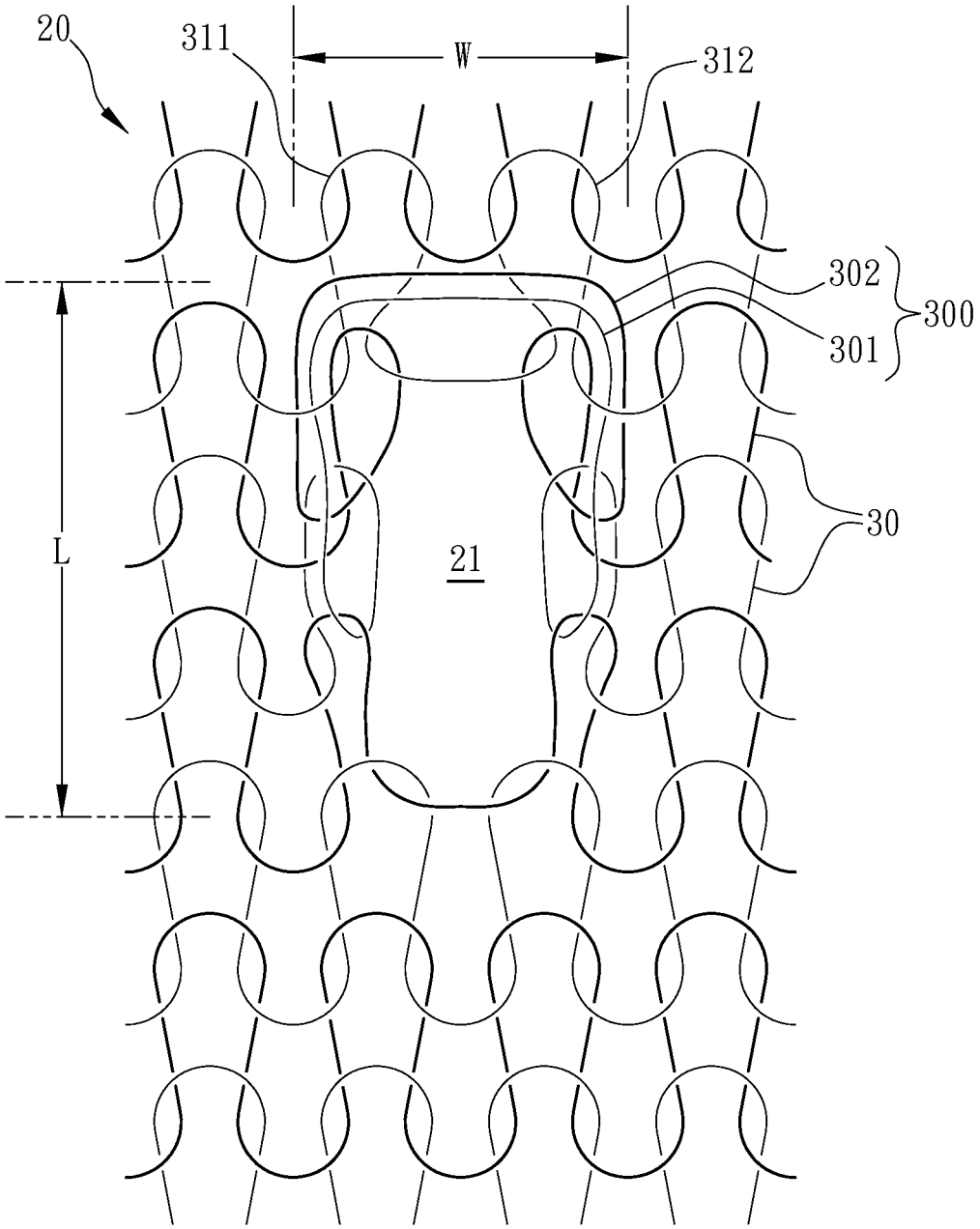
FIG. 3 is a fragmentary enlarged view according to FIG. 2.
Figure 4:
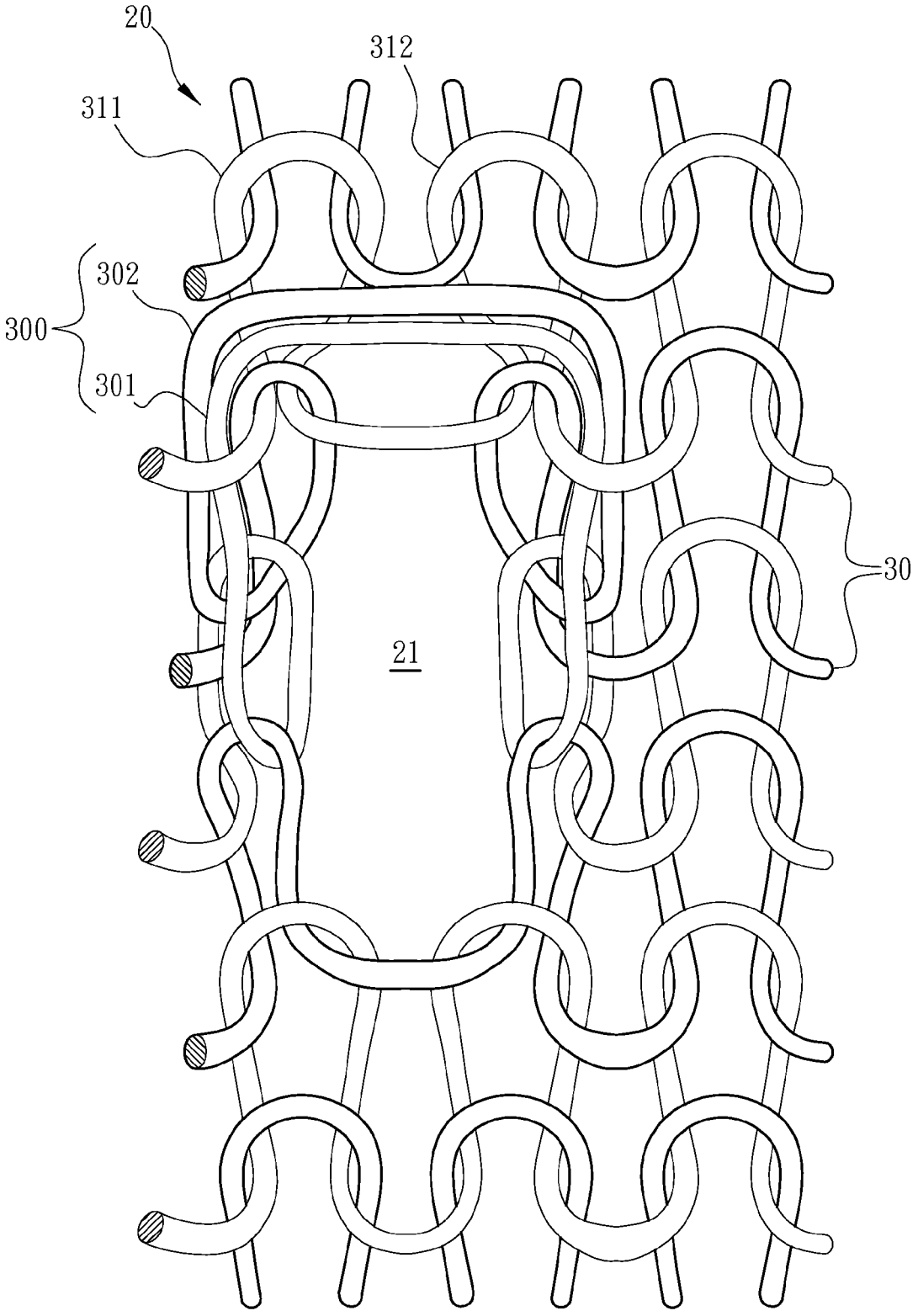
FIG. 4 is a fragmentary perspective view according to FIG. 3.
Figure 5:
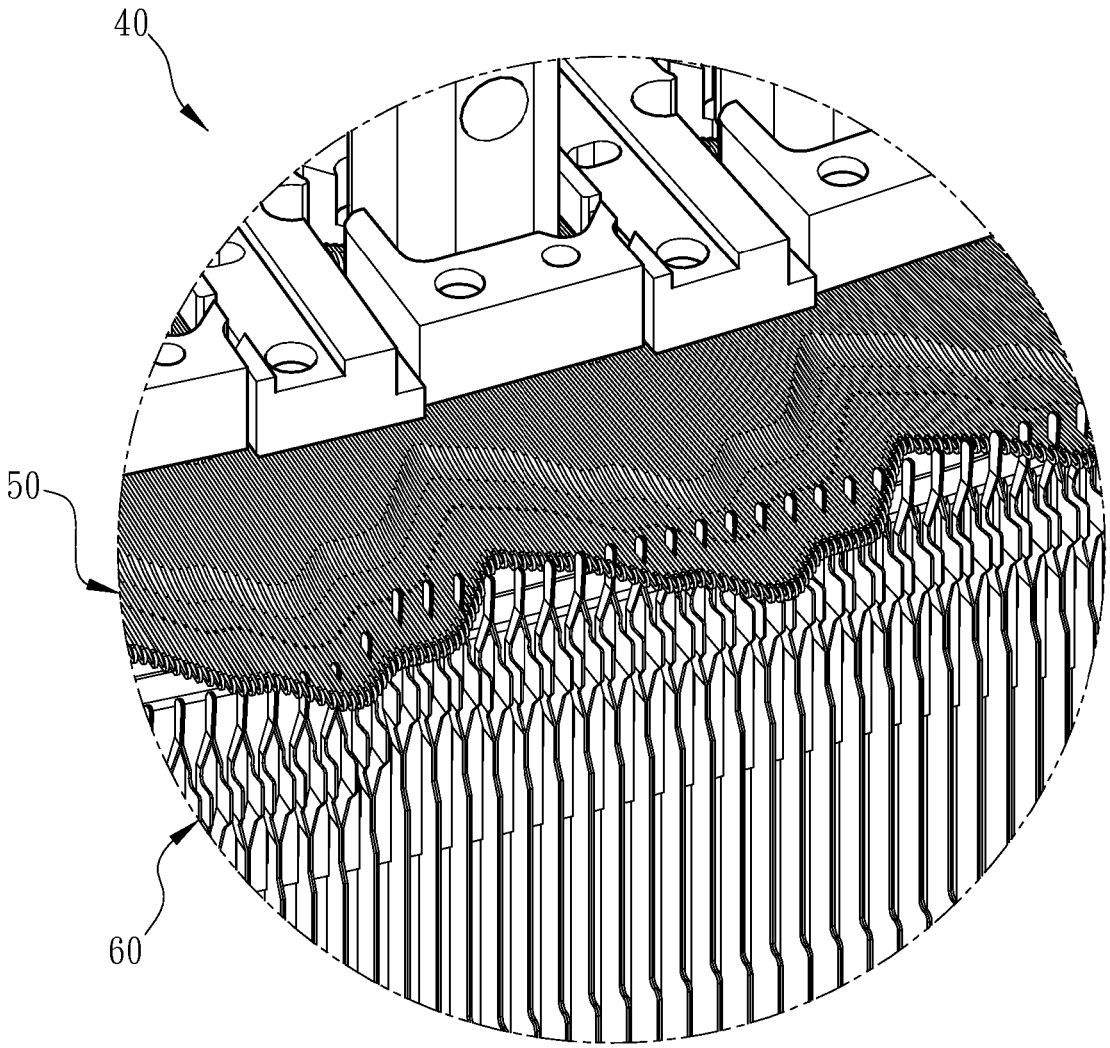
FIG. 5 is a fragmentary schematic view of a circular knitting machine used in the invention.
Figure 6:
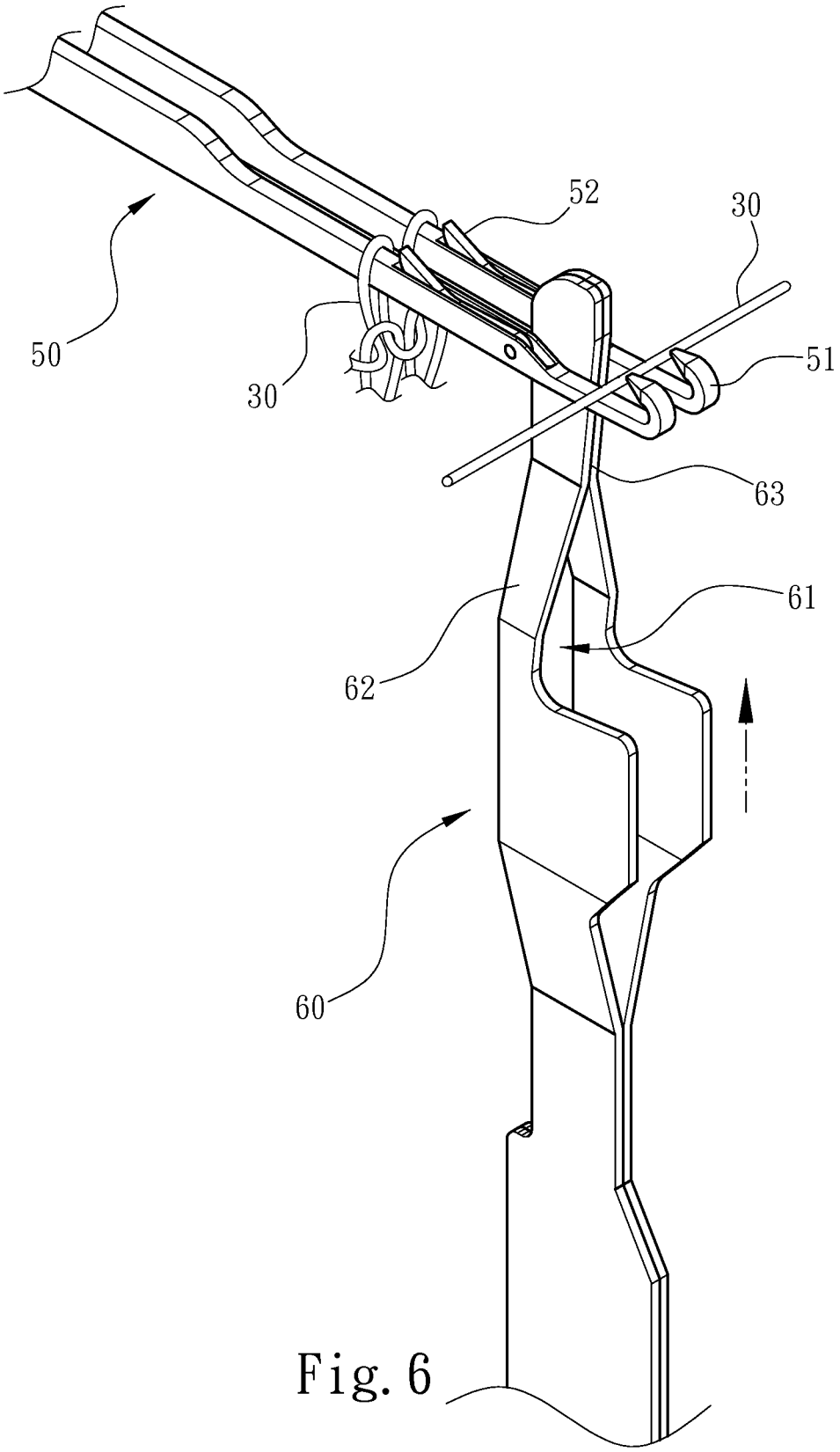
FIGS. 6 through 13 are fragmentary enlarged views of the Dial sinker in a first form in FIG. 5 and schematic views of the Dial sinker and latch needles in continuous knitting operation conditions by transferring the yarn twice.
Figure 7:
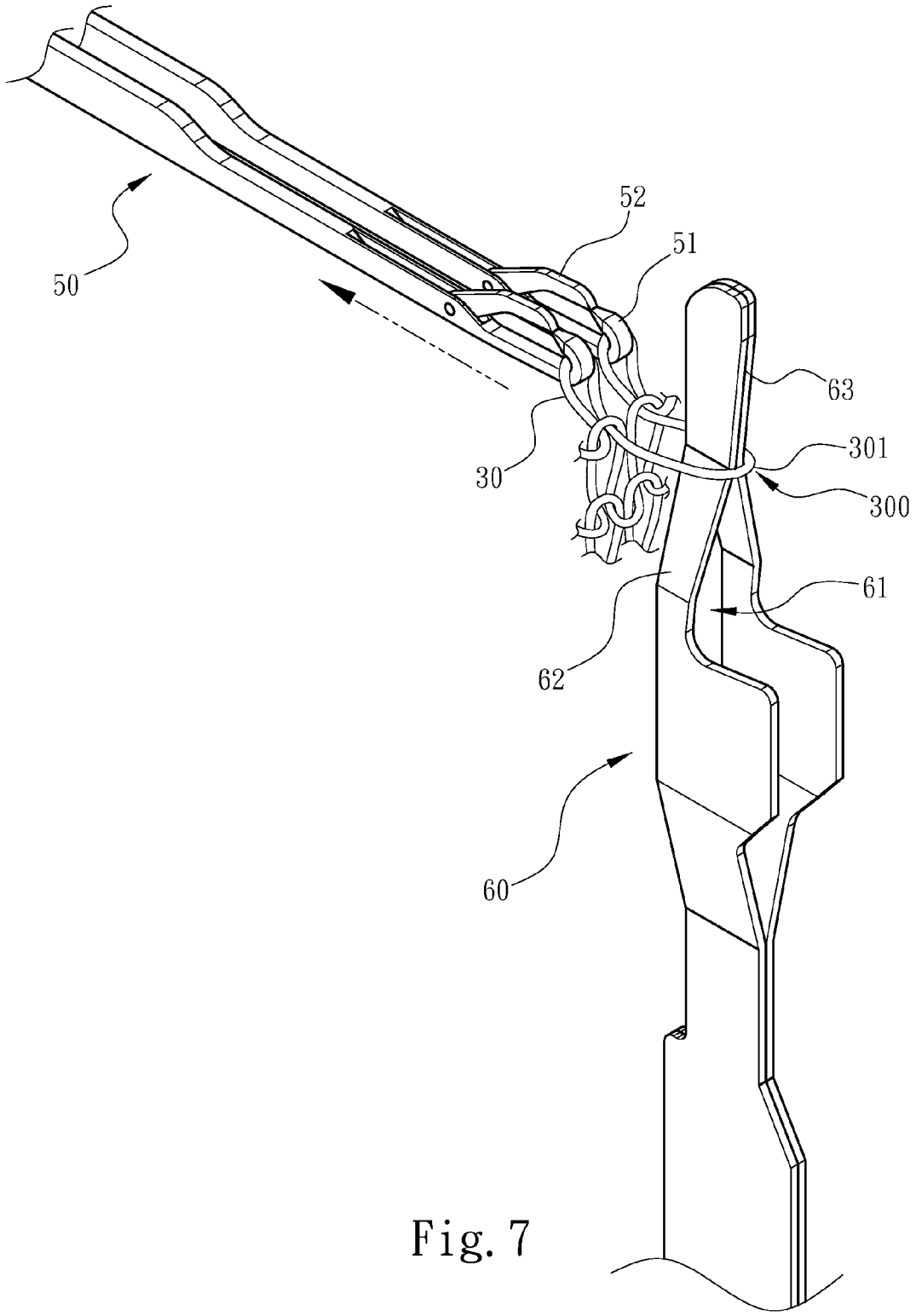
Figure 8:
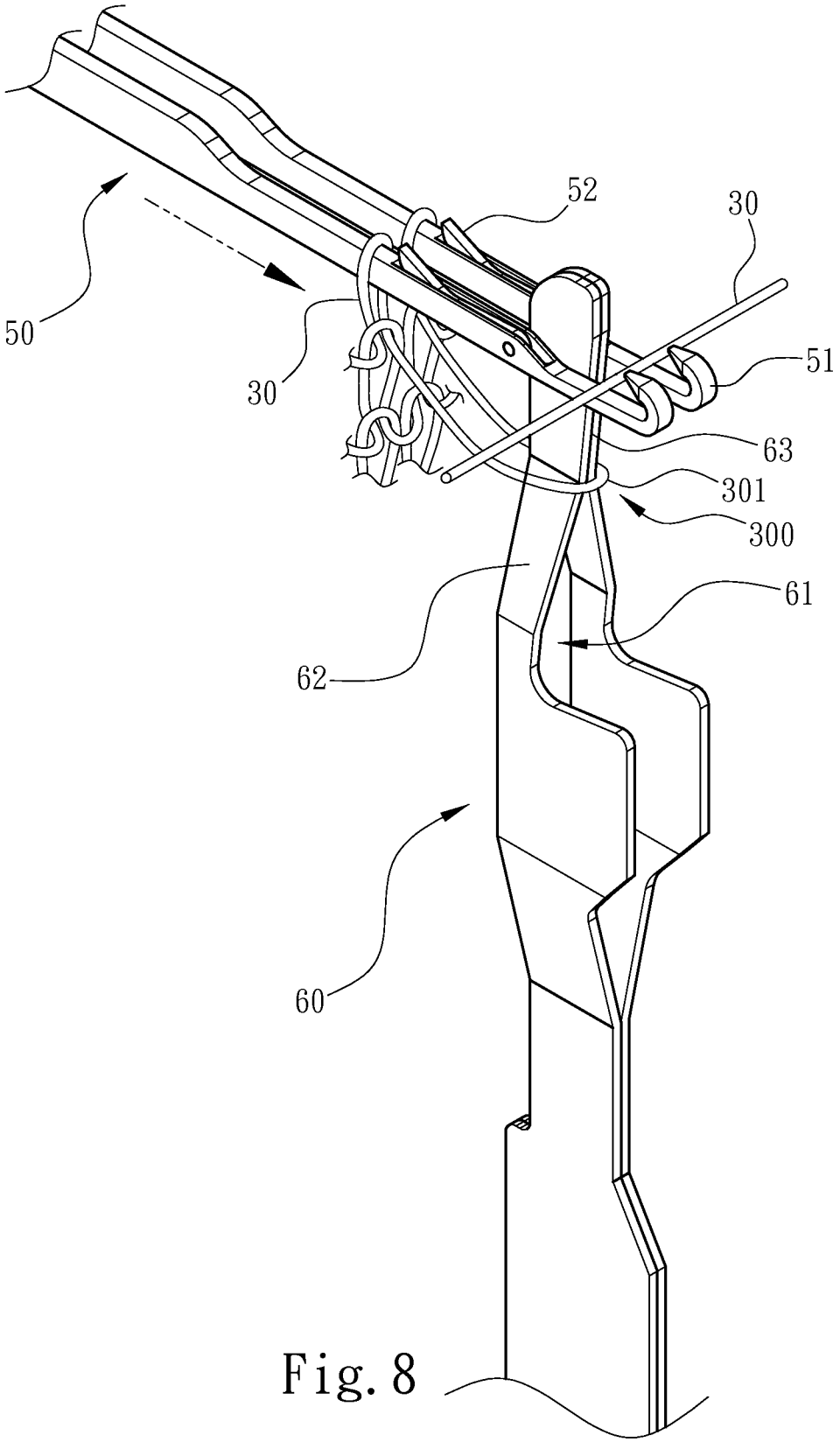
Figure 9:
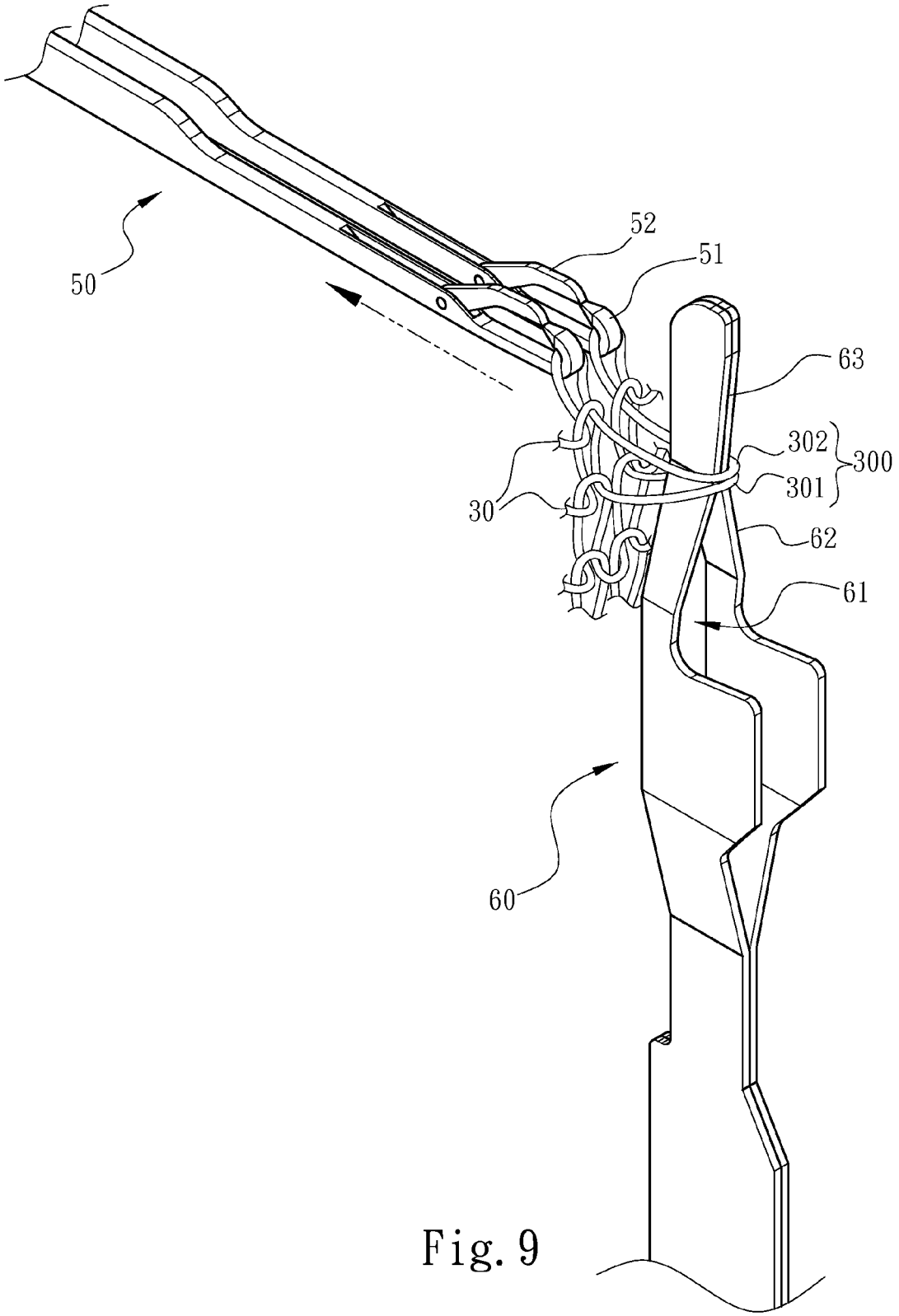
Figure 10:
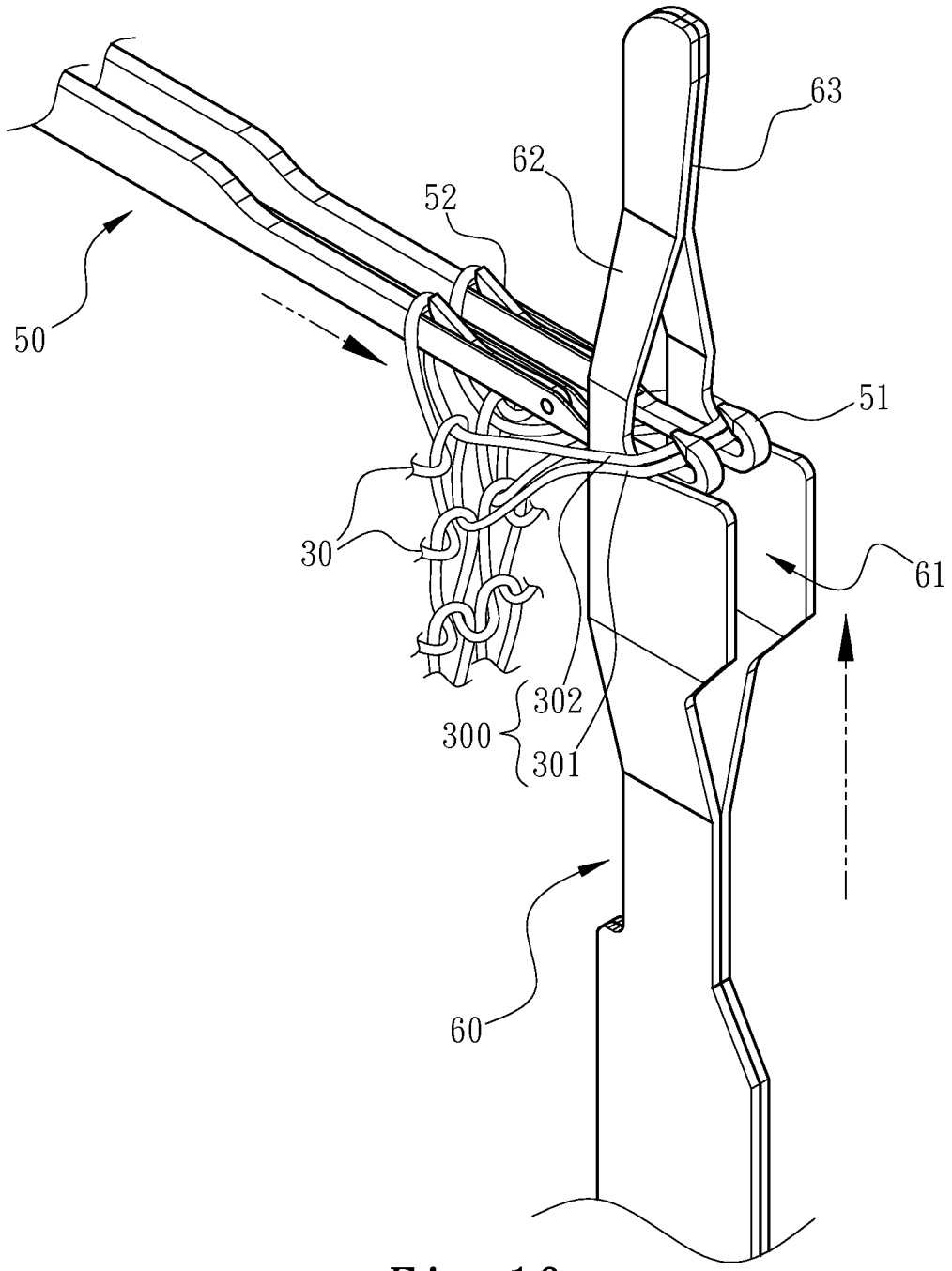
Figure 11:
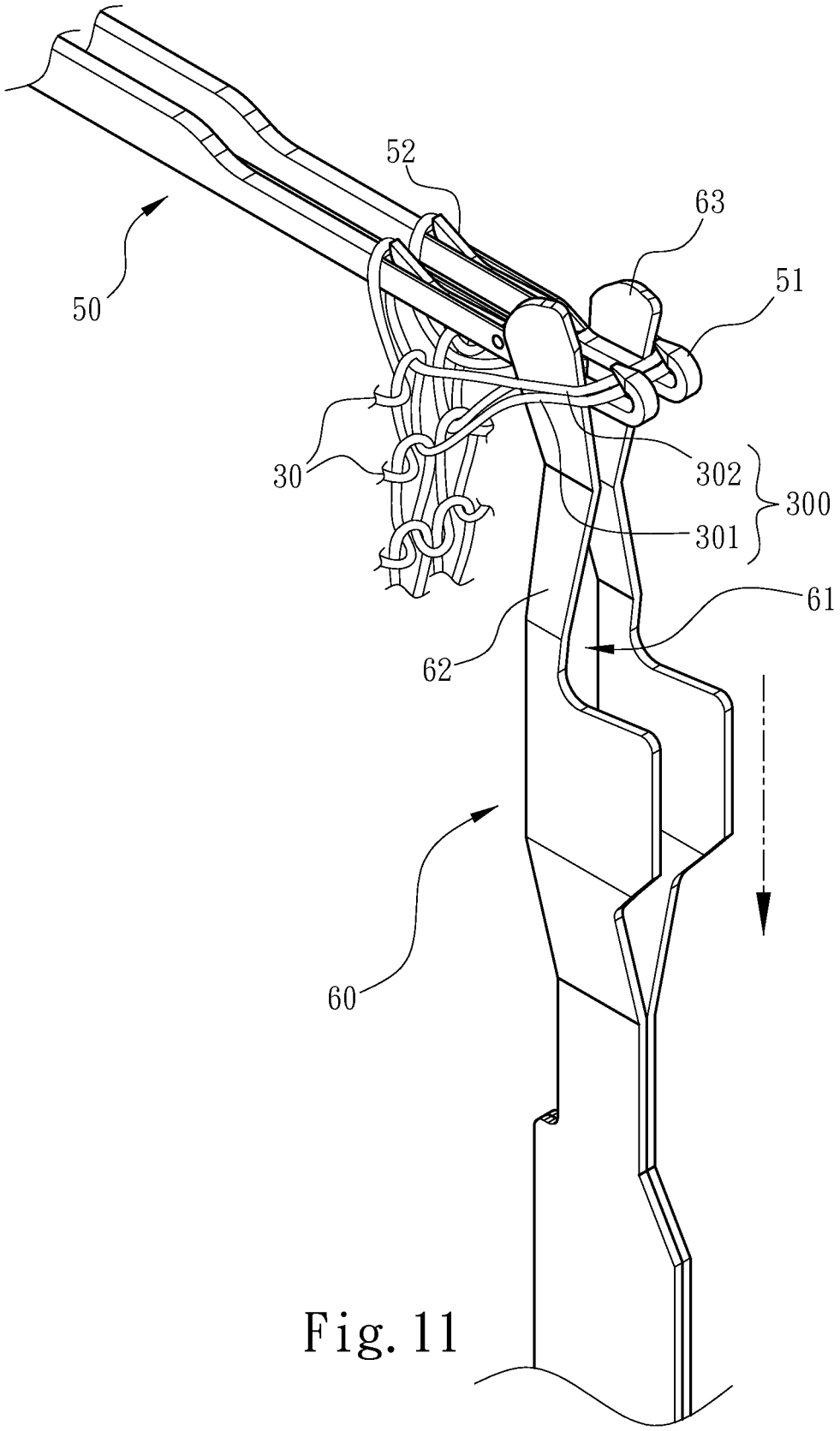
Figure 12:
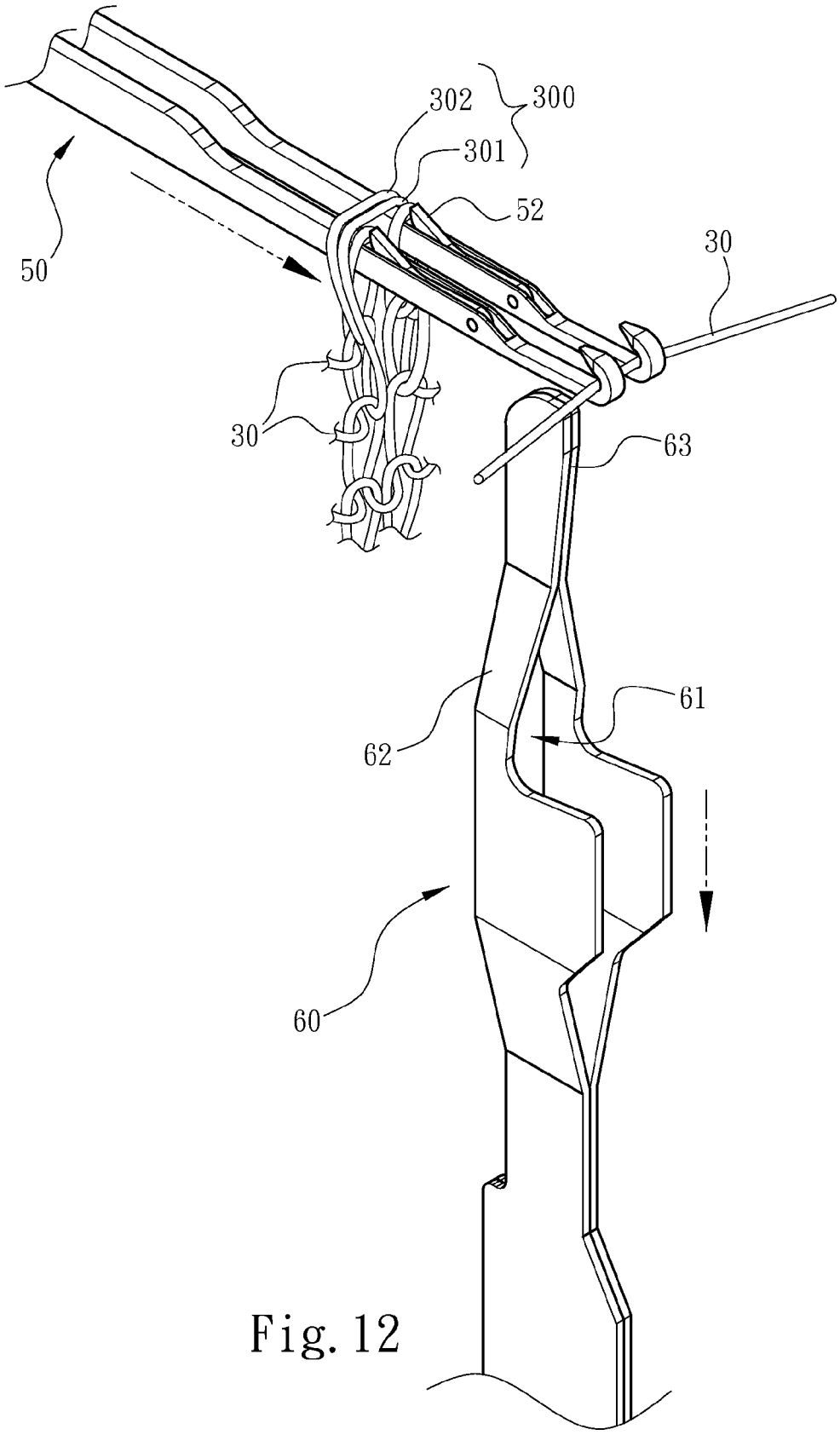
Figure 13:
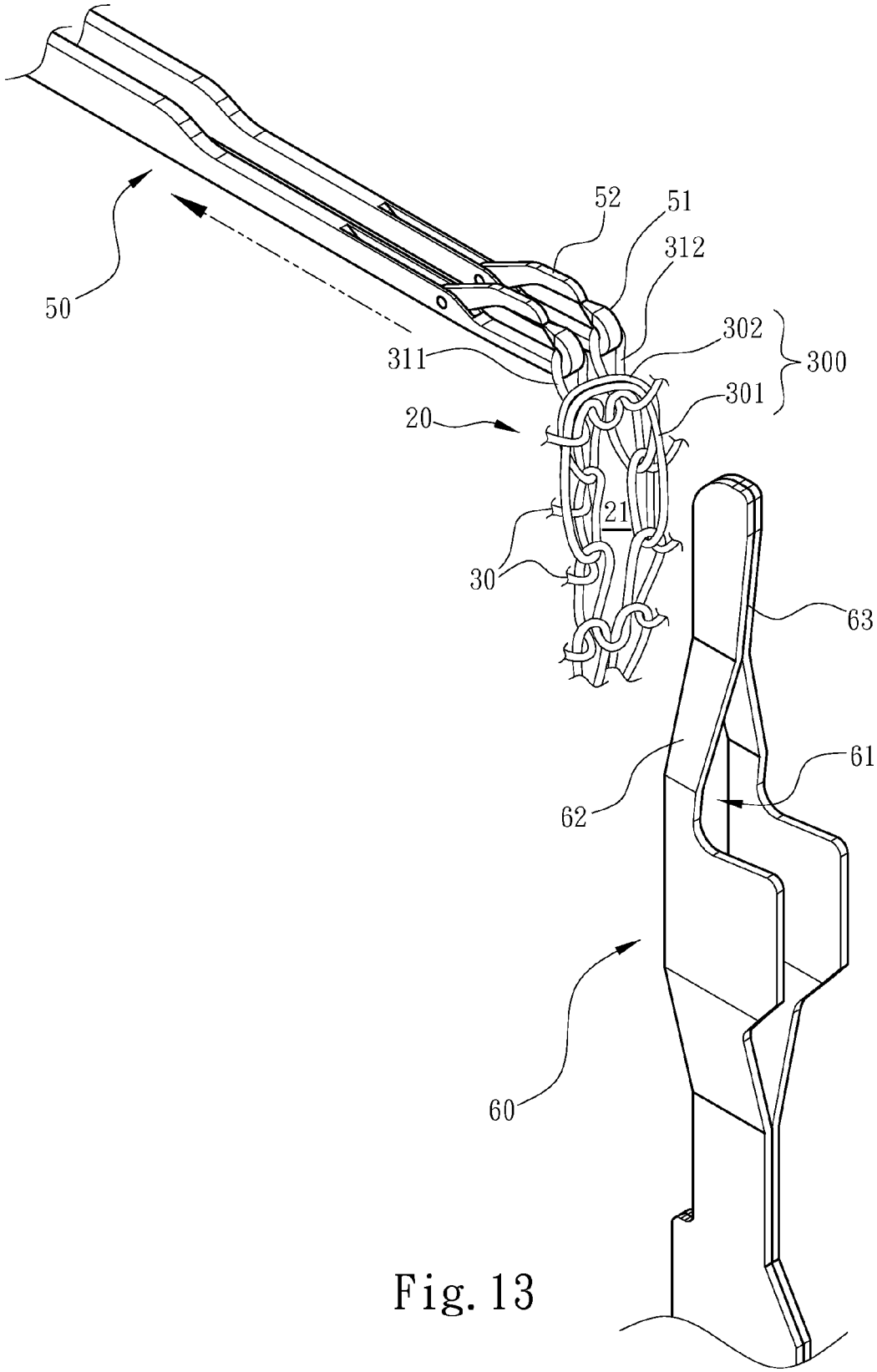
Figure 14:
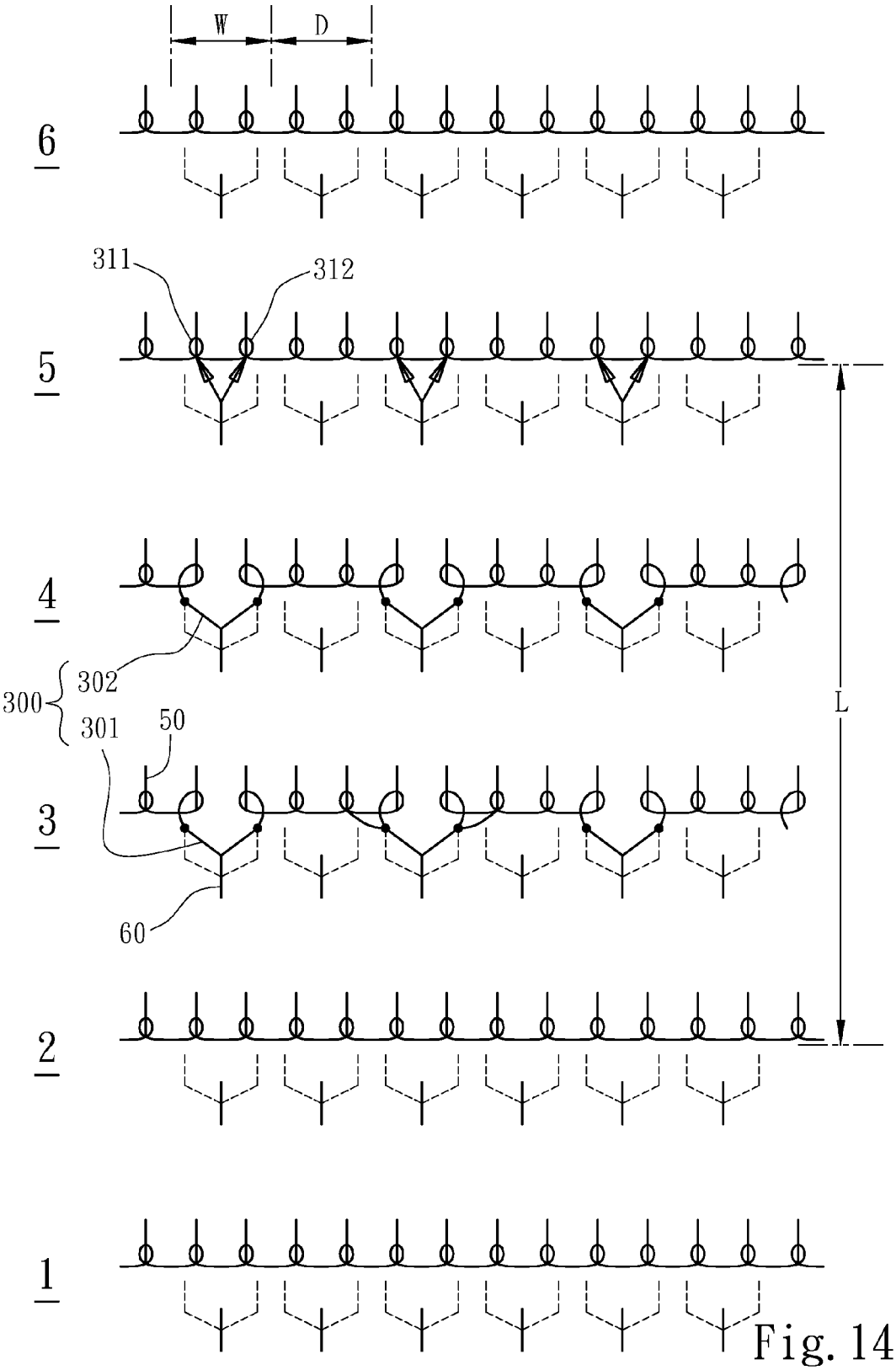
FIG. 14 is a schematic view of the knitting process of the invention according to FIG. 3 by transferring the yarn twice.

To facilitate discussion of the first embodiment of the fine knitwear 20, FIGS. 6 through 14 illustrate continuous operation conditions of knitting process according to FIG. 5 with the Dial sinker shaped in a first form and the latch needles transferring the yarn twice, and FIG. 3 illustrates a knitting process with the yarn transferred twice. First, as shown in FIG. 6, two latch needles 50 are provided each has a hook 51 at a front end and a latch 52 to close the hook 51. The Dial sinker 60 has an opening 61 at an upper side to allow the two latch needles 50 to pass through in a perpendicular manner at the same time, a guide portion 62 extended from the upper side of the opening 61 at two sides thereof, and an extended portion 63 extended from the upper side of the guide portion 62. When the circular knitting machine 40 is activated (referring to FIG. 5) knitting operation can be started according to a preset knitting process (such as knitting with the yarn transferred twice, as shown in FIG. 14). During knitting process 1 and knitting process 2 the two latch needles 50 catch a yarn 30 to form two loops that are coupled together, namely, when the two latch needles 50 catch the yarn 30 to form the loops in normal conditions the Dial sinker 60 is lowered to the lowest position without generating interactive movements with the two latch needles 50; next, the two latch needles 50 perform knitting operation according to another knitting process 3, and the Dial sinker 60 is moved slightly upward to form interactive movements with the two latch needles 50 as show in FIG. 6; next, the two latch needles 50 catch in different time sequence the yarn 30 fed subsequently to form a first transferred yarn 301 on the extended portion 63 as shown in FIG. 7; similarly, the two latch needles 50 perform knitting operation according to a further knitting process 4, thereafter the Dial sinker 60 forms interactive movements with the two latch needles 50 as show in FIG. 8, and the two latch needles 50 catch the yarn 30 fed next to form a second transferred yarn 302 on the extended portion 63 as shown in FIG. 9; then the knitting operation can proceed according to yet another knitting process 5, and the Dial sinker 60 is moved upward again until the two latch needles 50 extend into the opening 61; at that moment the Dial sinker 60 moves upward rapidly to make the first transferred yarn 301 and the second transferred yarn 302 to drop at the same time inside the hook 51 at the front end of the two latch needles 50 as shown in FIG. 10; then the Dial sinker 60 drops quickly to the lowest position to allow the first transferred yarn 301 and the second transferred yarn 302 to be moved away from the Dial sinker 60 by the two latch needles 50 at the same time as shown in FIG. 11; meanwhile, the two latch needles 50 are fully extended again to catch the yarn 30 fed next time as shown in FIG. 12, and also form a first support loop 311 and a second support loop 312 that are symmetrical against the first transferred yarn 301 and the second transferred yarn 302 on the left side and the right side of the first transferred yarn 301 and the second transferred yarn 302 to support and tie the first transferred yarn 301 and the second transferred yarn 302, and an air permeable hole 21 also is formed as shown in FIG. 12; finally, in order to separate one air permeable hole 21 and another air permeable hole 21 another knitting process 6 can be performed so that the two latch needles 50 can catch the yarn 30 fed subsequently to form loops as in the normal conditions.

Figure 15:
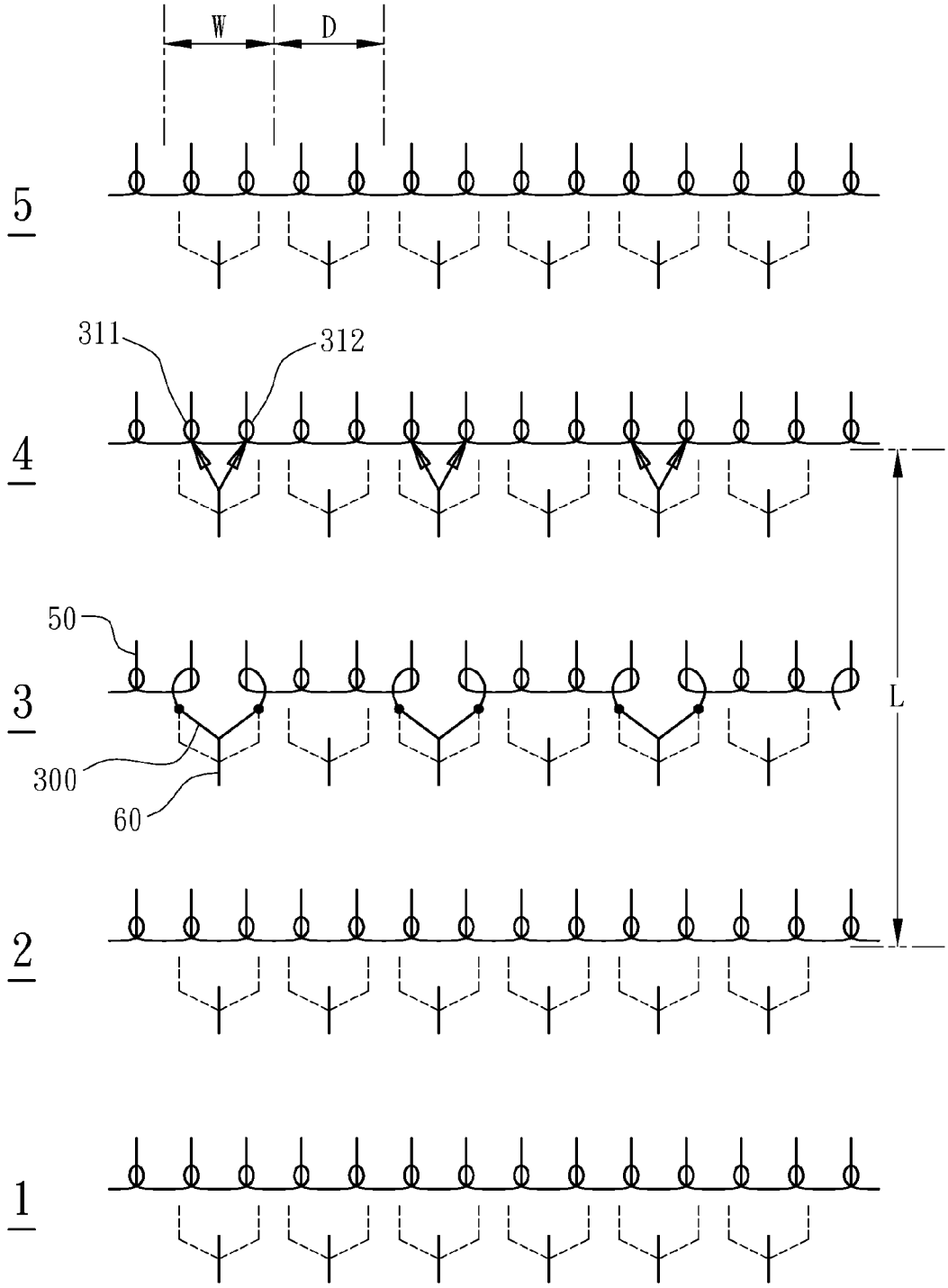
FIG. 15 is a schematic view of the knitting process of the invention by transferring the yarn once.
Figure 16:
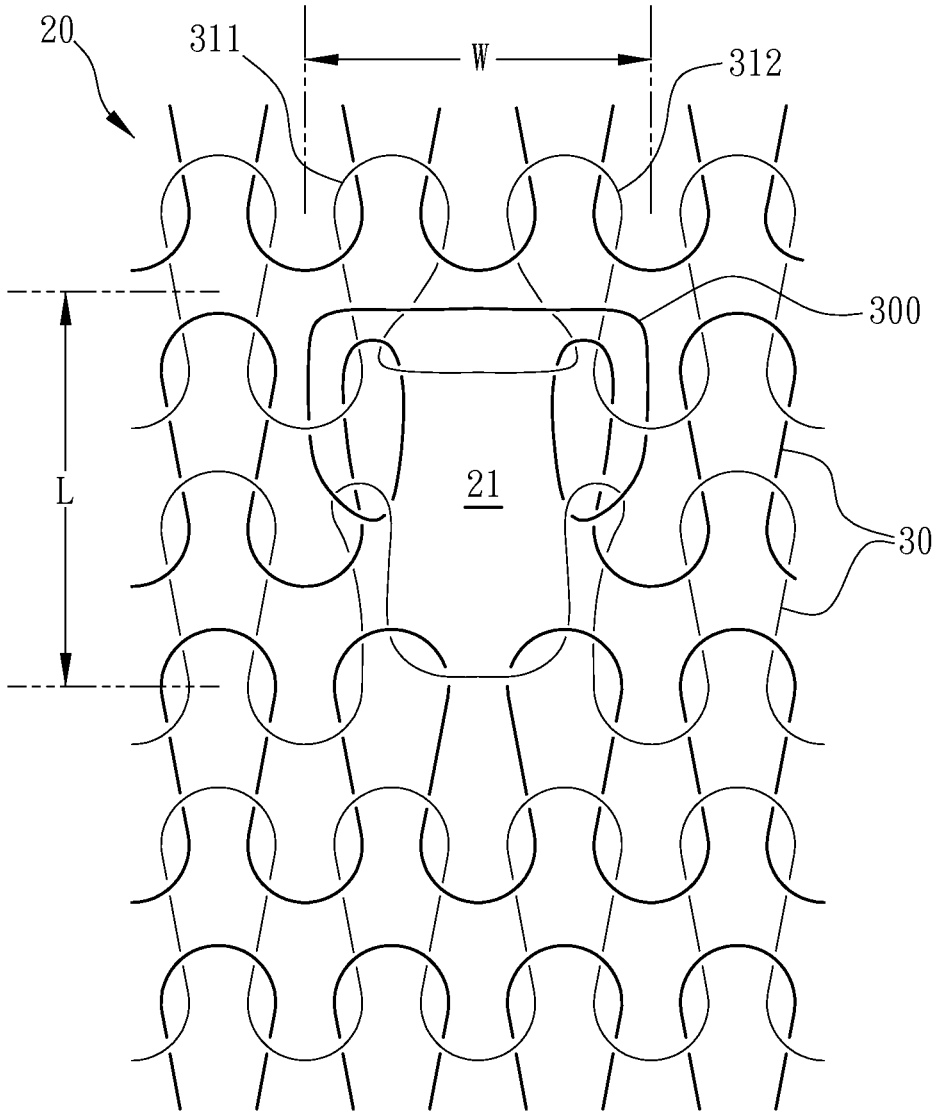
FIG. 16 is a fragmentary enlarged view of a second embodiment of the invention according to FIG. 15.

Refer to FIGS. 15 and 16 for a second embodiment of the invention. The second embodiment is implemented by omitting the knitting process 4 in the first embodiment previously discussed as shown in FIG. 14, and the resulting knitting process is shown in FIG. 15; namely, after the circular knitting machine 40 (as shown in FIG. 5) is activated it performs the knitting operation in the knitting processes 1 and 2 with the yarn 30 transferred once, and the yarn 30 is caught to form two coupled loops in the normal conditions; next, the knitting process 3 is carried out to form a transferred yarn 300; after the knitting process 4 is performed a first support loop 311 and a second support loop 312 are formed that are symmetrical against the transferred yarn 300 on the left side and the right side to support and tie the transferred yarn 300, and an air permeable hole 21 also is formed as shown in FIG. 16; finally, the air permeable hole 21 and another air permeable hole 21 are separated and spaced from each other, and the knitting process 5 is performed to finish knitting of the loop. It is to be noted that the width W of the hole in the second embodiment is same as that in the first embodiment, but the length L of the hole in the second embodiment is smaller than that in the first embodiment.

Figure 17:
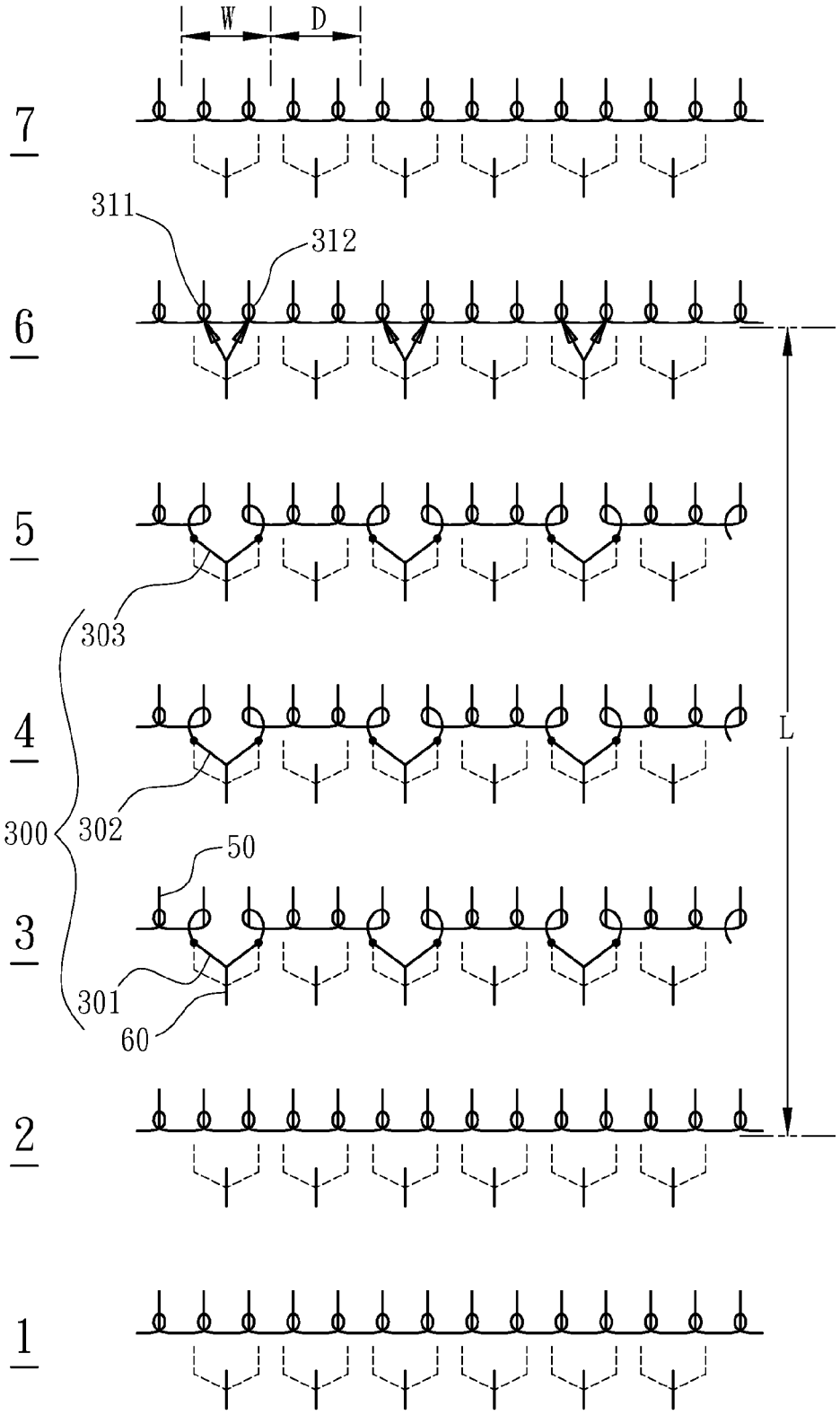
FIG. 17 is a schematic view of the knitting process of the invention by transferring the yarn three times.
Figure 18:
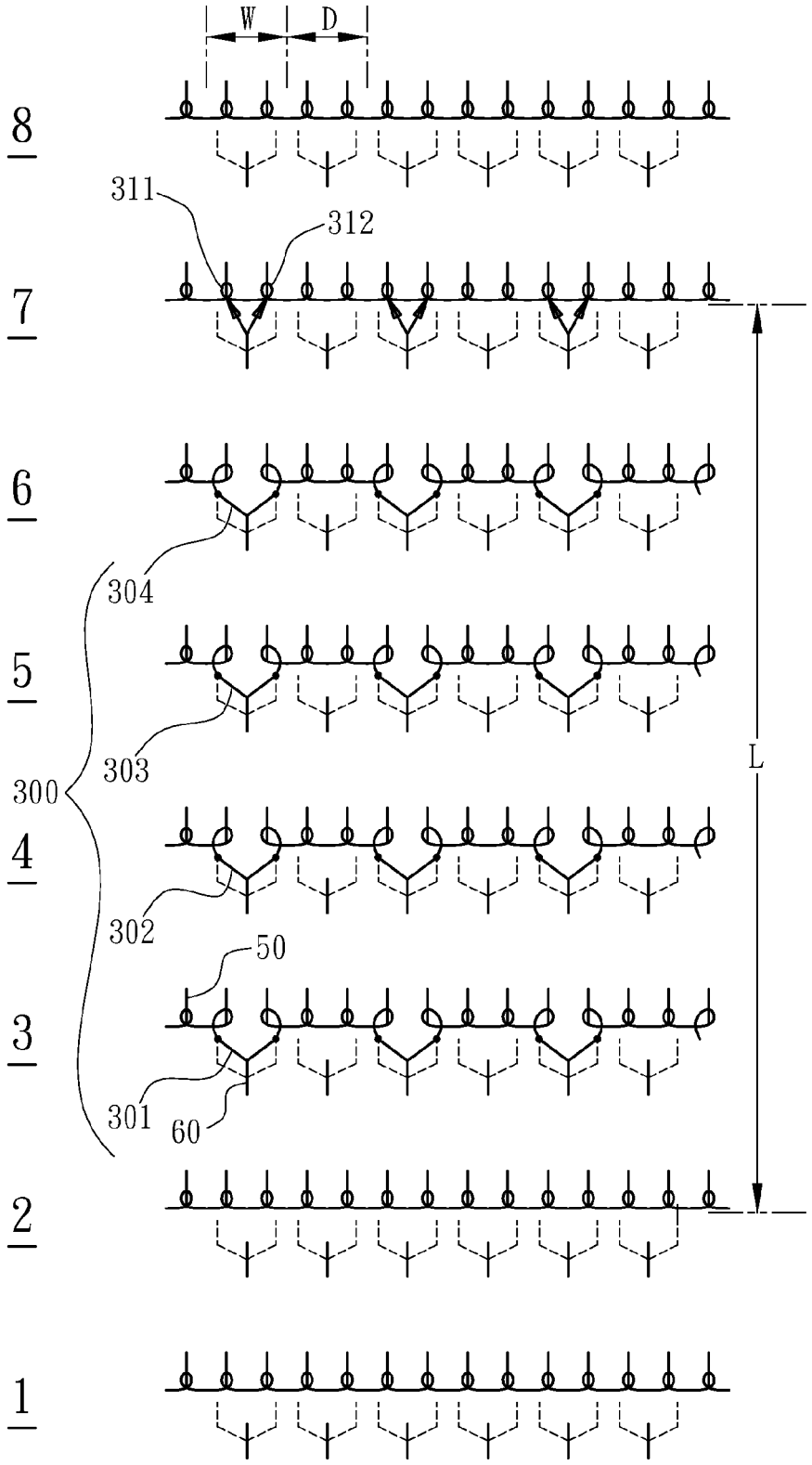
FIG. 18 is a schematic view of the knitting process of the invention by transferring the yarn four times.

FIGS. 17 and 18 illustrate the knitting processes of the invention with the yarn transferred three times and four times. Compared FIGS. 17 and 18 with FIG. 14, after the knitting process 4 shown in FIG. 14, another knitting process 5 is added in FIG. 17 to form a third transferred yarn 303, or additional knitting process 5 to form the third transferred yarn 303 and knitting process 6 to form a fourth transferred yarn are added in FIG. 18. It is to be noted that the width W of the hole in FIGS. 17 and 18 is same as that in FIG. 14, but the length L of the hole in FIGS. 17 and 18 is greater than that in FIG. 14, and the length L of the hole in FIG. 18 also is greater than that in FIG. 17.

Figure 19:
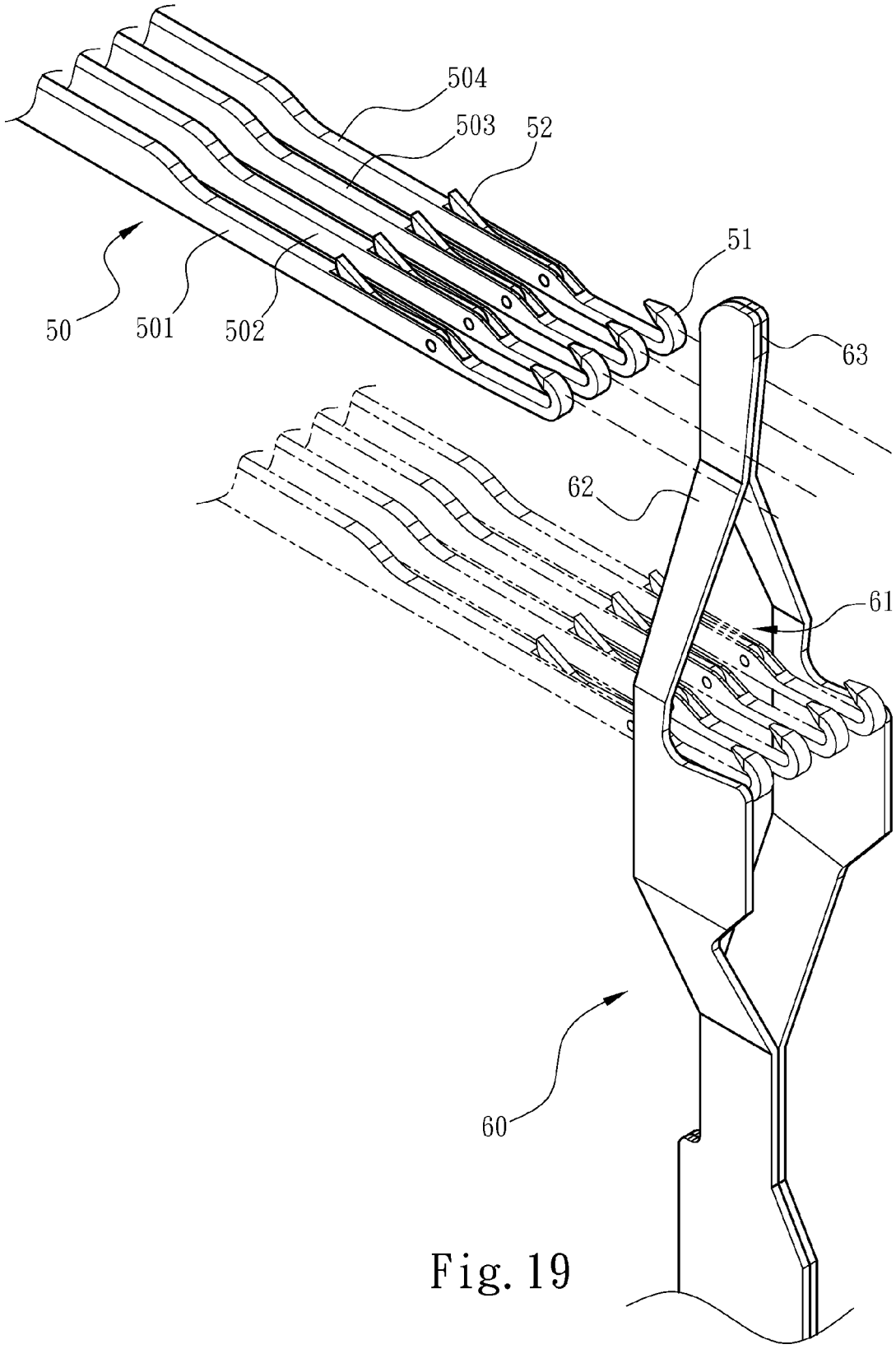
FIG. 19 is a fragmentary enlarged view of relative positioning of the Dial sinker in a second form and the latch needles according to FIG. 5.
Figure 20:
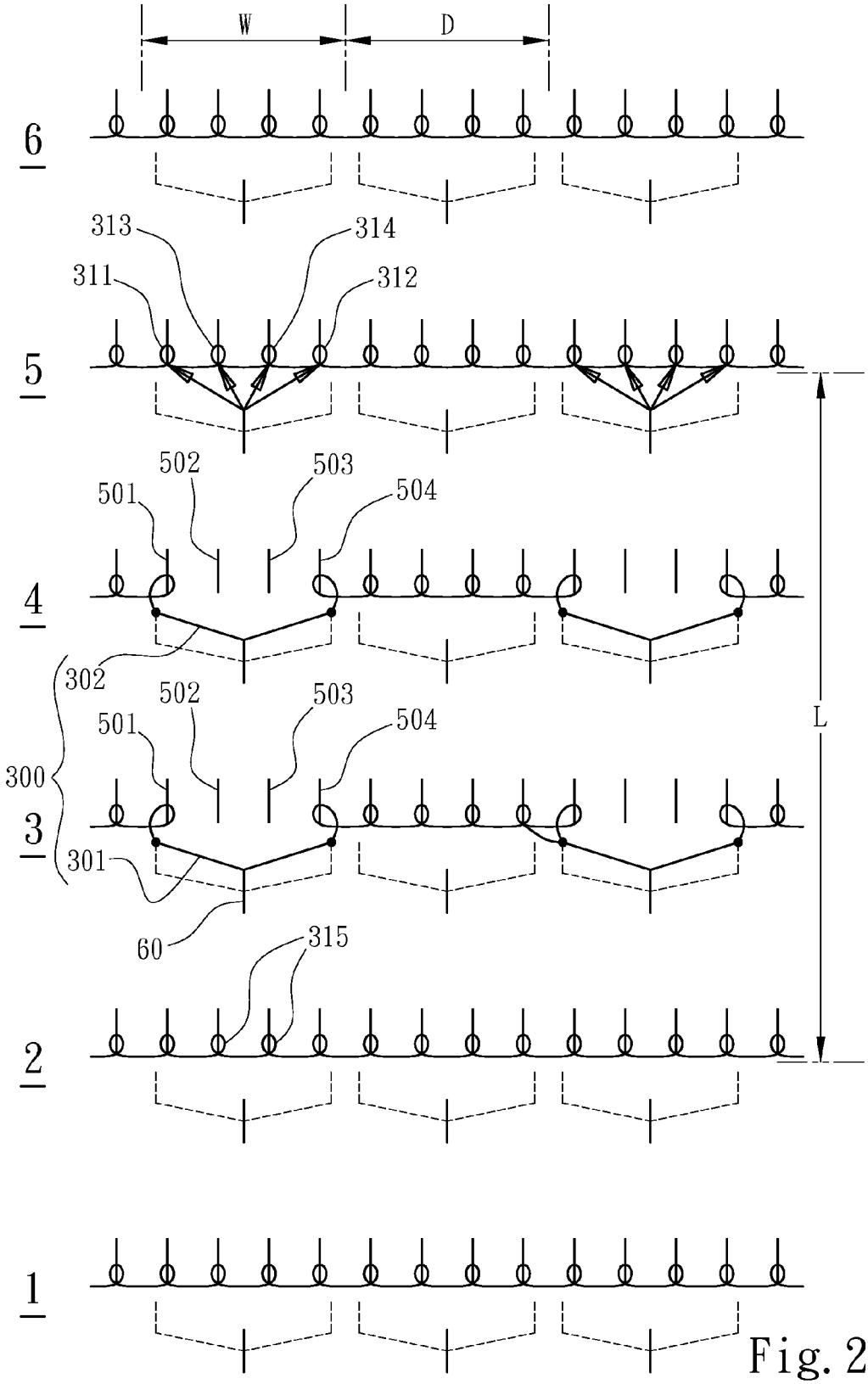
FIG. 20 is a schematic view of a first knitting process of the invention by transferring the yarn twice through the Dial sinker in the second form shown in FIG. 19.
Figure 21:
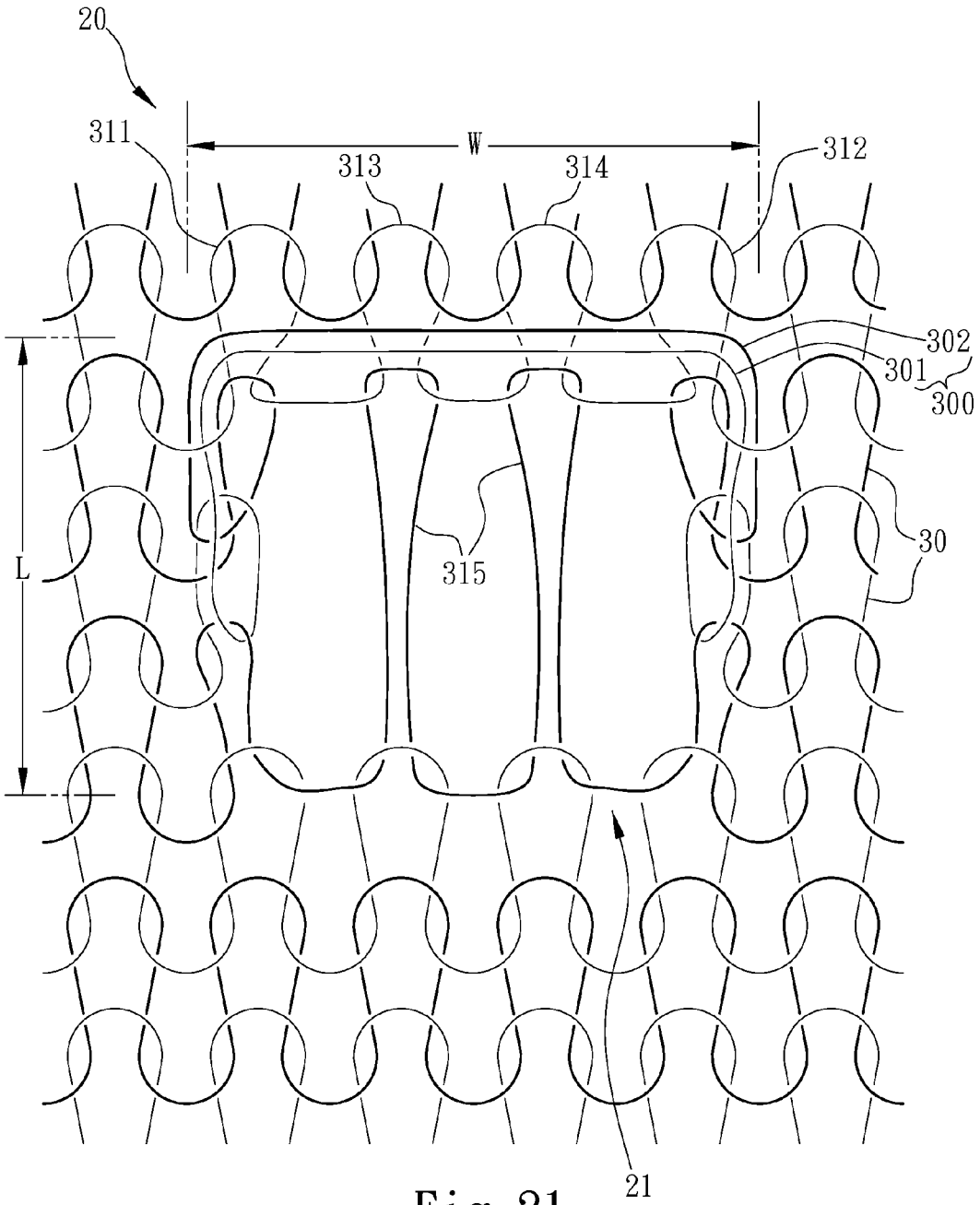
FIG. 21 is a fragmentary enlarged view of a third embodiment of the invention according to FIG. 20.

Refer to FIGS. 19 through 21 for a third embodiment with the Dial sinker shaped in a second form and positioned relative to the latch needles, and a first knitting process with the yarn transferred twice. First, as shown in FIG. 19, four latch needles 50 (a first latch needle 501, a second latch needle 502, a third latch needle 503 and a fourth latch needle 504) are provided each has a hook 51 at the front end and a latch 52 to close the hook 51, and the Dial sinker 60 has an opening 61 at the upper side to allow the first latch needle 501, the second latch needle 502, the third latch needle 503 and the fourth latch needle 504 to pass through perpendicularly at the same time, a guide portion 62 extended from the upper side of the opening 61 at two sides and an extended portion 63 extended from the upper side of the guide portion 62. When the circular knitting machine 40 (as shown in FIG. 5) is activated knitting operation according to a preset knitting process (as shown in FIG. 20 for a knitting process of transferring the yarn twice) can be performed. During the knitting processes 1 and 2, the four latch needles 50 (including the first latch needle 501, the second latch needle 502, the third latch needle 503 and the fourth latch needle 504) catch the yarn 30 fed in the normal conditions to form respectively two loops that are coupled with each other; namely, when the four latch needles 50 catch the yarn 30 to form the loops in the normal conditions the Dial sinker 60 is lowered to the lowest position without generating interactive movement with the latch needles 50; next, knitting operation is performed according to the knitting process 3 with the first latch needle 501 and the fourth latch needle 504 fully extended, and the second latch needle 502 and the third latch needle 503 extended one half, and the Dial sinker 60 rises slightly to form interactive movements with the first latch needle 501 and the fourth latch needle 504, then the first latch needle 501 and the fourth latch needle 504 knit respectively in different time sequence the yarn 30 fed next time on the extended portion 63 to form the first transferred yarn 301; similarly, after the knitting process 4 is performed the Dial sinker 60 and the first latch needle 501 and the fourth latch needle 504 form interactive movements with each other to form the second transferred yarn 302 on the extended portion 63 again through the yarn 30 fed the next time; after the knitting operation of the knitting process 5 is finished the Dial sinker 60 rises until the first latch needle 501, the second latch needle 502, the third latch needle 503 and the fourth latch needle 504 pass through the opening 61, then the Dial sinker 60 rises rapidly such that the first transferred yarn 301 and the second transferred yarn 302 drop at the same time to the hooks 51 at the front ends of the first latch needle 501, the second latch needle 502, the third latch needle 503 and the fourth latch needle 504; next, the Dial sinker 60 lowers rapidly to the lowest position such that the first transferred yarn 301 and the second transferred yarn 302 are moved away from the Dial sinker 60 at the same time by the first latch needle 501, the second latch needle 502, the third latch needle 503 and the fourth latch needle 504, meanwhile the first latch needle 501, the second latch needle 502, the third latch needle 503 and the fourth latch needle 504 are fully extended to catch the yarn 30 fed next time, and the first latch needle 501 and the second latch needle 502 form respectively a first support loop 311 and a second support loop 312 that are symmetrical against the first transferred yarn 301 and the second transferred yarn 302 on the left side and the right side of the first transferred yarn 301 and the second transferred yarn 302 to support and tie the first transferred yarn 301 and the second transferred yarn 302, and an air permeable hole 21 also is formed. It is to be noted that the second latch needle 502 and the third latch needle 503 also can form respectively a third support loop 313 and a fourth support loop 314 between the first support loop 311 and the second support loop 312; and the air permeable hole 21 also has two spaced loops 315 formed by yarn binding of the third support loop 313 and the fourth support loop 314 at the same time. Finally, in order to separate the air permeable hole 21 and another air permeable hole 21 the knitting process 6 is performed to allow the first latch needle 501, the second latch needle 502, the third latch needle 503 and the fourth latch needle 504 to catch the yarn 30 fed next to form the loops in the normal conditions as the third embodiment shown in FIG. 21. It is to be noted that the width W of the hole formed in the third embodiment is greater than that of the first embodiment, and the length L of the hole in the third embodiment is same as that of the first embodiment. Similarly, when the yarn transferring quantity is changed, the L of the hole also is changed accordingly no matter how many latch needles 50 passing through the opening 61 of the Dial sinker 60 at the same time.

Figure 22:
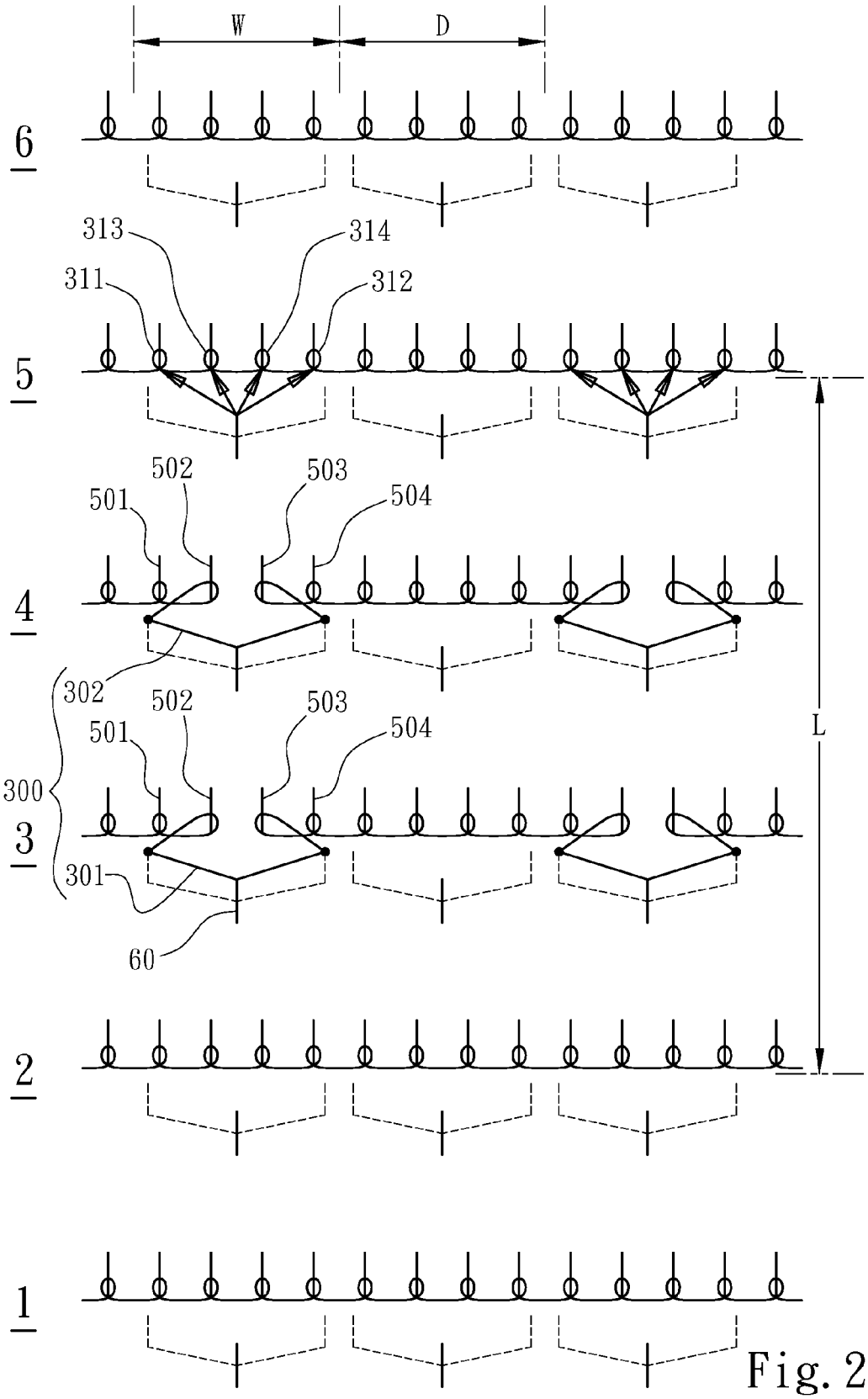
FIG. 22 is a schematic view of a second knitting process of the invention by transferring the yarn twice through the Dial sinker in the second form shown in FIG. 19.
Figure 23:
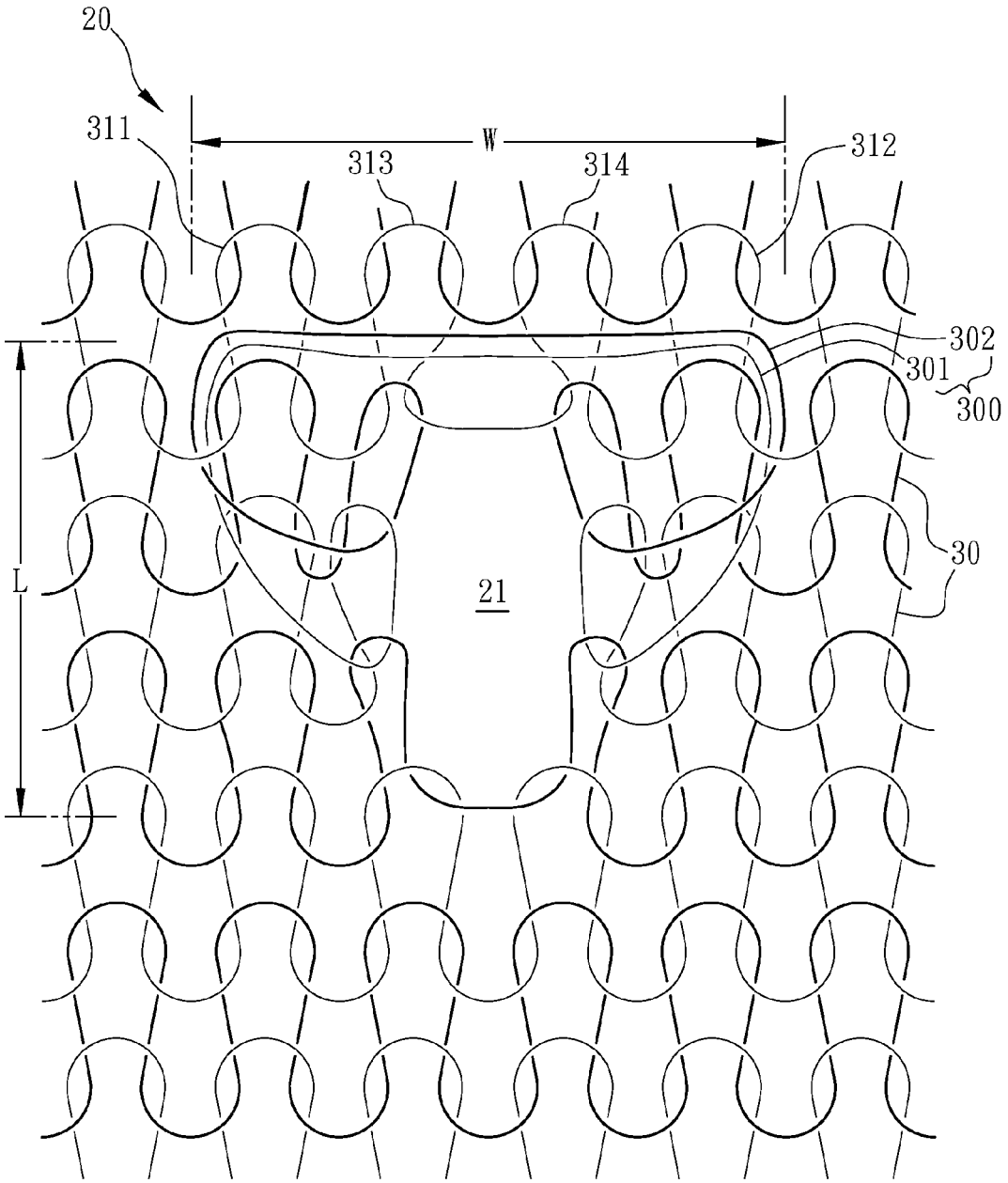
FIG. 23 is a fragmentary enlarged view of a fourth embodiment of the invention according to FIG. 22.

Refer to FIGS. 22 and 23 for a fourth embodiment with the Dial sinker shaped in the second form and a second knitting process with the yarn transferred twice. As shown in the drawings, when the circular knitting machine 40 is activated (as shown in FIG. 5) knitting operation according to a present knitting process (such as the knitting process with yarn transferred twice shown in FIG. 22) is performed. During the knitting processes 1 and 2 the four latch needles 50 (including a first latch needle 501, a second latch needle 502, a third latch needle 503 and a fourth latch needle 504) catch the yarn 30 in normal conditions to form two loops which are coupled with each other; namely, when the four latch needles 50 catch the yarn 30 to form the loops in the normal conditions the Dial sinker 60 is lowered to the lowest position without generating interactive movement with the fourth latch needles 504; next, knitting operation is performed according to the knitting process 3 with the first latch needle 501, the second latch needle 502, the third latch needle 503 and the fourth latch needle 504 fully extended, and the Dial sinker 60 rises slightly to form interactive movements with the second latch needle 502 and the third latch needle 503, then the first latch needle 501, the second latch needle 502, the third latch needle 503 and the fourth latch needle 504 catch respectively in different time sequence the yarn 30 fed next time, and the second latch needle 502 and the third latch needle 503 form on the extended portion 63 the first transferred yarn 301; similarly, when knitting operation of the knitting process 4 is performed the Dial sinker 60 forms interactive movements with the second latch needle 502 and the third latch needle 503 that also catch the yarn 30 fed next time to form the second transferred yarn 302 on the extended portion 63; after knitting operation of the knitting process 5 is finished the Dial sinker 60 rises again until the first latch needle 501, the second latch needle 502, the third latch needle 503 and the fourth latch needle 504 pass through the opening 61, at that moment the Dial sinker 60 rises rapidly so that the first transferred yarn 301 and the second transferred yarn 302 drop at the same time to the hooks 51 at the front ends of the first latch needle 501, the second latch needle 502, the third latch needle 503 and the fourth latch needle 504; next, the Dial sinker 60 lowers rapidly to the lowest position such that the first transferred yarn 301 and the second transferred yarn 302 are moved away from the Dial sinker 60 at the same time by the first latch needle 501, the second latch needle 502, the third latch needle 503 and the fourth latch needle 504, meanwhile the first latch needle 501, the second latch needle 502, the third latch needle 503 and the fourth latch needle 504 are fully extended to catch the yarn 30 fed next time, and the first latch needle 501 and the fourth latch needle 504 form respectively a first support loop 311 and a second support loop 312 that are symmetrical against the first transferred yarn 301 and the second transferred yarn 302 on the left side and the right side of the first transferred yarn 301 and the second transferred yarn 302 to support and tie the first transferred yarn 301 and the second transferred yarn 302, and an air permeable hole 21 also is formed. It is to be noted that the second latch needle 502 and the third latch needle 503 also can form respectively a third support loop 313 and a fourth support loop 314 between the first support loop 311 and the second support loop 312; Finally, in order to separate the air permeable hole 21 from another air permeable hole 21 knitting operation of the knitting process 6 can be performed to allow the first latch needle 501, the second latch needle 502, the third latch needle 503 and the fourth latch needle 504 to catch the yarn 30 fed next to form the loops in the normal conditions as the fourth embodiment shown in FIG. 23. It is to be noted that the width W of the hole formed in the fourth embodiment is greater than that of the first embodiment; similarly, due to the fourth embodiment transfers the yarn twice, the length L of the hole in the fourth embodiment is greater than that of the first embodiment.

Figure 24:
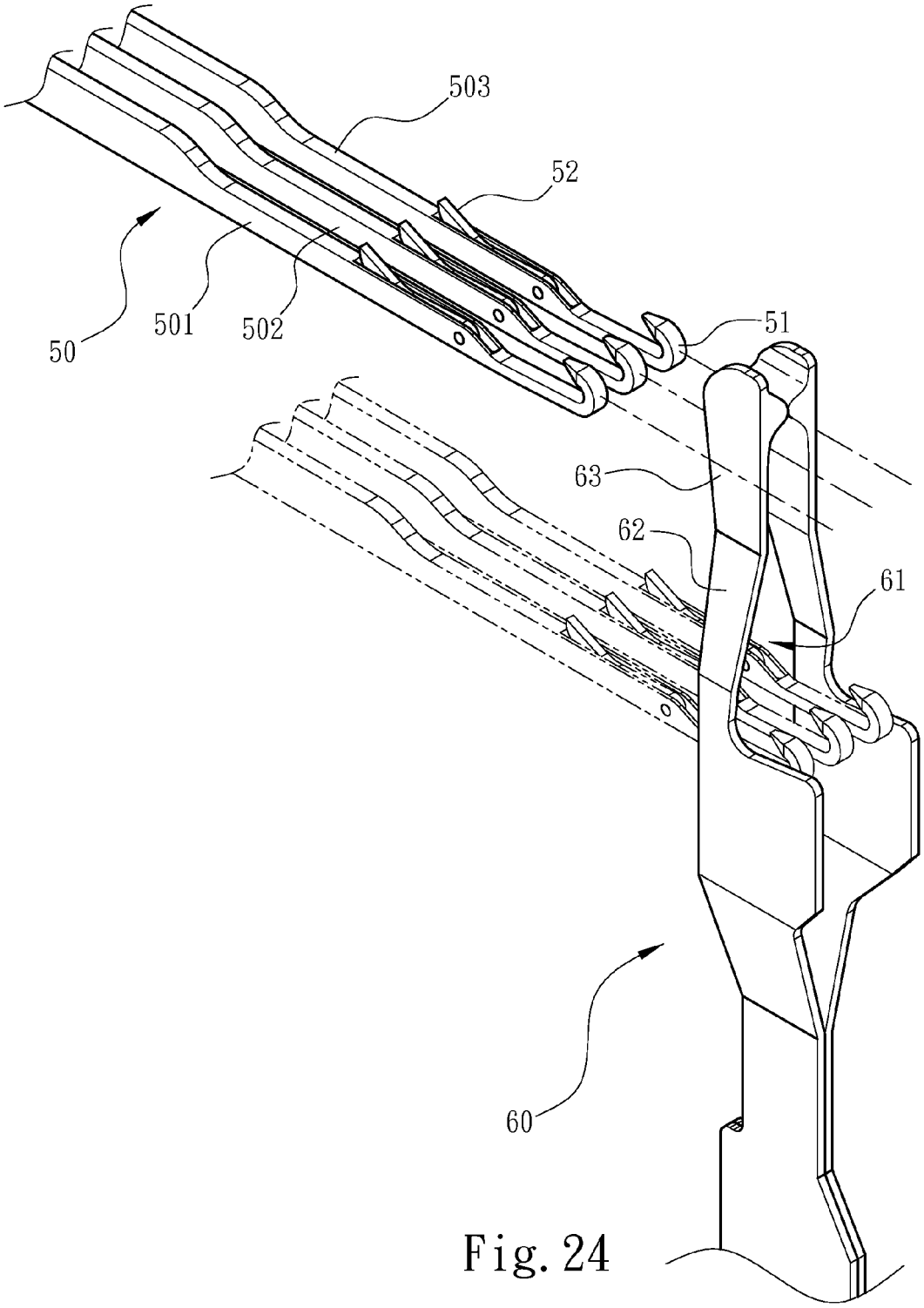
FIG. 24 is a fragmentary enlarged view of relative positioning of the Dial sinker in a third form and the latch needles according to FIG. 5.
Figure 25:
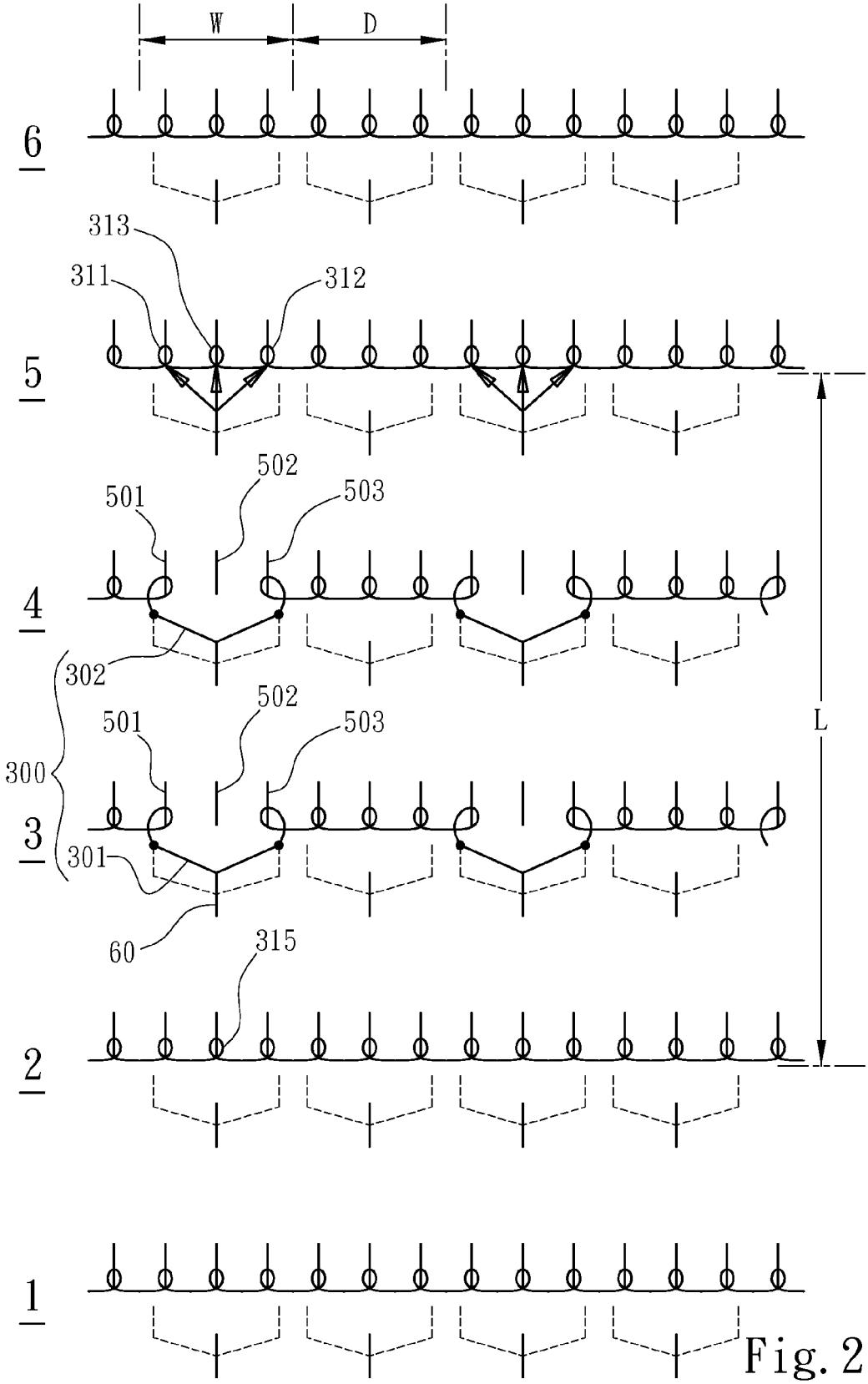
FIG. 25 is a schematic view of the knitting process of the invention by transferring the yarn twice through the Dial sinker in the third form shown in FIG. 24.
Figure 26:
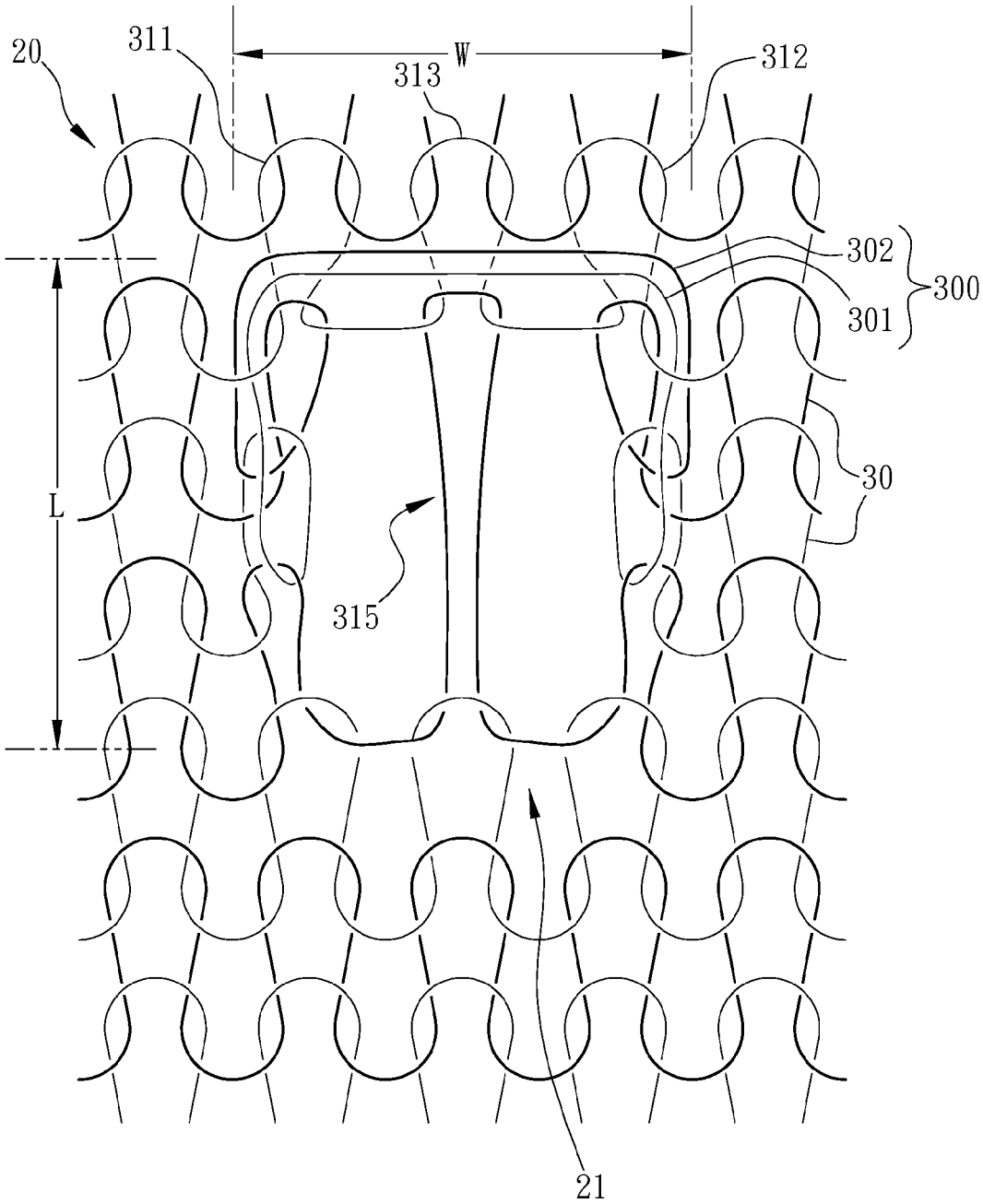
FIG. 26 is a fragmentary enlarged view of a fifth embodiment of the invention according to FIG. 25.

Refer to FIGS. 24, 25 and 26 for a fifth embodiment with the Dial sinker shaped in a third form and positioned relative to the latch needles, and a knitting process with the yarn transferred twice. First, as shown in FIG. 24, three latch needles 50 (including a first latch needle 501, a second latch needle 502 and a third latch needle 503) are provided each has a hook 51 at the front end and a latch 52 to close the hook 51, and the Dial sinker 60 includes an opening 61 to allow the first latch needle 501, the second latch needle 502 and the third latch needle 503 to pass through perpendicularly, a guide portion 62 extended from the upper side of the opening 61 at two sides and an extended portion 63 extended from the upper side of the guide portion 62. When the circular knitting machine 40 is activated (as shown in FIG. 5) knitting operation according to a present knitting process (such as the knitting process with yarn transferred twice shown in FIG. 25) can be performed. During the knitting processes 1 and 2 the three latch needles 50 (including the first latch needle 501, the second latch needle 502 and the third latch needle 503) catch the yarn 30 in normal conditions to form two loops which are coupled with each other; namely, when the three latch needles 50 catch the yarn 30 to form the loops in the normal conditions the Dial sinker 60 is lowered to the lowest position without generating interactive movements with the three latch needles 50; next, knitting operation is performed according to the knitting process 3 with the first latch needle 501 and the third latch needle 503 fully extended, while the second latch needle 502 is extended one half, and the Dial sinker 60 rises slightly to form interactive movements with the first latch needle 501 and the third latch needle 503, then the first latch needle 501 and the third latch needle 503 catch the yarn 30 fed next time to form the first transferred yarn 301 on the extended portion 63; similarly, when knitting operation of the knitting process 4 is performed the Dial sinker 60 forms interactive movements with the first latch needle 501 and the third latch needle 503 that also catch the yarn 30 fed next time to form the second transferred yarn 302 on the extended portion 63; after knitting operation of the knitting process 5 is finished the Dial sinker 60 rises again until the first latch needle 501, the second latch needle 502 and the third latch needle 503 pass through the opening 61, at that moment the Dial sinker 60 rises rapidly so that the first transferred yarn 301 and the second transferred yarn 302 drop at the same time to the hooks 51 at the front ends of the first latch needle 501, the second latch needle 502 and the third latch needle 503; next, the Dial sinker 60 lowers rapidly to the lowest position such that the first transferred yarn 301 and the second transferred yarn 302 are moved away from the Dial sinker 60 at the same time by the first latch needle 501, the second latch needle 502 and the third latch needle 503, meanwhile the first latch needle 501, the second latch needle 502 and the third latch needle 503 are fully extended to catch the yarn 30 fed next time, and the first latch needle 501 and the third latch needle 503 form respectively a first support loop 311 and a second support loop 312 that are symmetrical against the first transferred yarn 301 and the second transferred yarn 302 on the left side and the right side of the first transferred yarn 301 and the second transferred yarn 302 to support and tie the first transferred yarn 301 and the second transferred yarn 302, and an air permeable hole 21 also is formed. It is to be noted that the second latch needle 502 also can form a third support loop 313 between the first support loop 311 and the second support loop 312, and the air permeable hole 21 also has a spaced loop 315 inside formed by yarn binding of the third support loop 313; finally, in order to separate the air permeable hole 21 from another air permeable hole 21 knitting operation of the knitting process 6 can be performed to allow the first latch needle 501, the second latch needle 502 and the third latch needle 503 to catch the yarn 30 fed next to form the loops in the normal conditions as the fifth embodiment shown in FIG. 26. It is to be noted that the width W of the hole formed in the fifth embodiment is greater than that of the first embodiment; similarly, due to the fifth embodiment transfers the yarn 30 twice, the length L of the hole in the fifth embodiment is greater than that of the first embodiment.

By means of the embodiments and the knitting processes previously discussed, it is clear that the air permeable hole 21 is formed in a symmetrical fashion on the left side and the right side, hence the width W of the hole can be formed greater. Moreover, the first transferred yarn 301 and the second transferred yarn 302 above the air permeable hole 21 are securely held by at least two support loops (the first support loop 311 and the second support loop 312), hence the structure of the air permeable hole 21 is firmer and can meet market requirements. In addition, the first transferred yarn 301 and the second transferred yarn 302 above the air permeable hole 21 stack over each other symmetrically on the left side and the right side, therefore a jutting 3D profile is formed above the air permeable hole 21. Thus, when the fine knitwear 20 is in contact with people's skin a plurality of gaps are formed between each air permeable hole 21 and the skin to improve air permeability. As a result, it can provide more comfortable cooling effect to meet consumers' requirements. Furthermore, through the Dial sinker 60 used in the invention the length L of the air permeable hole 21 and the distance D between neighboring air permeable holes 21 can be controlled, and by adjusting the shape of the Dial sinker 60 the width W or the shape of the air permeable hole 21 also can be controlled, therefore can meet emergency requirements in response to change of market.

What is claimed is:

1. A circular knitting machine for knitting a knitwear with air permeable holes, the circular knitting machine having a knitting fineness greater than or equal to 24 needles/inch, and the knitwear being a single face fabric knitted through the circular knitting machine and a plurality of spaced air permeable holes which are spaced from each other, the circular knitting machines further comprising:

a plurality of Dial sinkers and a plurality of latch needles perpendicular to the Dial sinkers, wherein a ratio of the Dial sinkers and the latch needles where correspond to the Dial sinkers is 1 to 4 each Dial sinker and four of the plurality of latch needles corresponding to the Dial sinker interacting with each other to form at least one transferred yarn located above each air permeable hole; and a first support loop and a second support loop respectively symmetrical against the transferred yarn on a left side and a right side of the transferred yarn to support and tie the transferred yarn.

2. The of circular knitting machine with air permeable holes of claim 1, wherein a third support loop and a fourth support loop are formed via interactive movements of the Dial sinker and the four latch needles and interposed between the first support loop and the second support loop, and the third support loop and the fourth support loop respectively symmetrical against the transferred yarn on the left side and the right side of the transferred yarn to support and tie the transferred yarn.

3. The of circular knitting machine for knitting a knitwear with air permeable holes of claim 2, wherein each Dial sinker and four of the plurality of latch needles corresponding to the Dial sinker interact with each other to form a first transferred yarn and a second transferred yarn located above each air permeable hole, wherein the first support loop, the second support loop, the third support loop and the fourth support loop are respectively symmetrical against the first transferred yarn and the second transferred yarn to support and tie the first transferred yarn and the second transferred yarn.

4. The circular knitting machine for knitting a knitwear with air permeable holes of claim 3, wherein the Dial sinker and four of the plurality of latch needles corresponding to the Dial sinker interact with each other to further form two spaced loops on the air permeable hole formed by yarn binding of the third support loop and the fourth support loop at the same time.

* * * * *